US009475085B2

(12) United States Patent
Komura et al.

(10) Patent No.: US 9,475,085 B2
(45) Date of Patent: Oct. 25, 2016

(54) FORMING APPARATUS

(75) Inventors: Masato Komura, Okayama (JP); Nagaoka Yoshiharu, Okayama (JP)

(73) Assignee: OOPARTS, INC, Okayama (JP)

( * ) Notice: Subject to any disclaimer, the term of this patent is extended or adjusted under 35 U.S.C. 154(b) by 226 days.

(21) Appl. No.: 13/820,269

(22) PCT Filed: Jul. 29, 2011

(86) PCT No.: PCT/JP2011/067505

§ 371 (c)(1),
(2), (4) Date: Mar. 1, 2013

(87) PCT Pub. No.: WO2012/029482

PCT Pub. Date: Mar. 8, 2012

(65) Prior Publication Data

US 2013/0164443 A1 Jun. 27, 2013

(30) Foreign Application Priority Data

Sep. 2, 2010 (JP) ..... 2010-196366

(51) Int. Cl.
*B05C 17/10* (2006.01)
*E04F 21/02* (2006.01)

(52) U.S. Cl.
CPC ..... *B05C 17/10* (2013.01); *E04F 21/02* (2013.01)

(58) Field of Classification Search
CPC ..... E04F 21/02; B05C 17/00; B05C 17/10
USPC ..... 118/102
See application file for complete search history.

(56) References Cited

U.S. PATENT DOCUMENTS 8,122,670 B2 * 2/2012 Matthee ..... E04F 15/02044 52/403.1

FOREIGN PATENT DOCUMENTS

| | | |
|---|---|---|
| JP | 98577/1986 | 6/1986 |
| JP | 11-062211 A | 5/1999 |
| JP | S 1478839 | 9/2013 |
| JP | S 1478840 | 9/2013 |
| JP | S 1461551 | 12/2013 |
| JP | S 1461552 | 12/2013 |

* cited by examiner

*Primary Examiner* — Xiao Zhao
(74) *Attorney, Agent, or Firm* — Trojan Law Offices

(57) ABSTRACT

Provided is a forming apparatus which forms an upper surface of adhesive substance to adhere tiles to a laying surface in a ridge-and-groove shape so as to prevent a wavy surface or unintended inclination. The forming apparatus includes tongue forming means having a plurality of tongues and a tongue securing portion; grasping means; and contact means. The tongues have gaps therebetween, and a free end protruding from a base end located on a bottom defining line in the protrusion direction perpendicular to the bottom defining line on a tongue existence plane. The base end of the tongues is attached to an edge portion. The grasping means is directly or indirectly attached to the tongue securing portion. The contact means has at least two contact points on a virtual plane perpendicular to the protrusion direction. The two contact points or legs thereof exist on a contact defining line.

19 Claims, 21 Drawing Sheets

(a)

(b)

(a)

(b)

FORMING APPARATUS

CROSS-REFERENCE TO RELATED APPLICATIONS

The present application is a U.S. National Stage Application under 35 U.S.C. 371 of PCT/JP2011/067505 filed on Jul. 29, 2011, which claims priority to Japanese Patent Application No. 2010-1906366, filed on Sep. 2, 2010.

TECHNICAL FIELD

The present invention relates to a forming apparatus, more specifically, it relates to a forming apparatus which forms an upper surface of an adhesive substance in a shape of ridge-and-groove, the adhesive substance being adapted to adhere tiles to a laying surface.

BACKGROUND OF THE INVENTION

Background Art

So many tiles such as natural rock slab or artificial rock slab have been utilized in order to mainly form a floor surface and the like. In order to lay tiles, it is necessary to apply an adhesive substance (normally mortar) which adheres a laying surface and the tiles to the laying surface. In addition, it is also necessary to form a ridge shape in which a groove and a ridge are alternately aligned and such pair of groove and ridge continues on an upper surface of the applied adhesive substance (normally mortar) in order to adjust each height of each tile. Various kinds of devices have been proposed in order to form such ridge shape on the upper surface of the adhesive substance (normally mortar) (for example, patent reference 1, etc.).

In the patent reference 1, it is described that "in order to lay and array with an even height a plurality of rock slabs 10 such as natural rock slab or artificial rock slab on the floor surface, the mortar is applied on the surface of an underlying surface 11 laid on the floor surface and a formed surface F2 composed of a plurality of rectangular and linear ridge-and-groove parts 12 on the upper surface of the mortar. And it is necessary to form such plurality of linear ridge-and-groove parts 12 evenly and horizontally on the upper surface of the mortar. Therefore, a trowel body (not shown) having a forming die having a shape of comb teeth has been utilized such that they are formed." and an object thereof is that "a method of forming an adhesive surface of the mortar and a trowel body for forming the same are provided such that an adhesive level with other plural rock slabs serving as a unit rock slab may be accurately obtained and an adhesive efficiency may be improved when the unit rock slab is boned with the mortar" (paragraphs [0009] in detailed explanation of the invention of Patent Reference 1). "A forming method of forming the mortar adhesive surface which can improve the adhesive efficiency as well as accurately provide adhesive level to a plurality of other unit rock plates when the unit rock plate is bonded and a trowel body for the method are provided," (paragraphs [0009] in detailed explanation of the invention of Patent Reference 1).

More specifically, the patent reference 1 proposes as follows. "The trowel body for forming the adhesive surface of the mortar having a plurality of linear ridge-and-groove parts on the adhesive surface of the mortar to adhere the unit rock slab on the underlying surface comprises at least a forming die in a evenly-corrugated shape having a curvature without any sharp corners on a ridge part or a valley part on one side end part. According to this feature, since the trowel body has the forming die formed in the evenly corrugated shape having the curvature without sharp corners in the ridge part or the valley part on the one side end part, the unit rock slab is positioned at an even level by the formation surface formed on the upper surface of the mortar by the forming die of the trowel and air bubbles or the like may not exist when the rock slab is pressed and adhered such that the adhesive efficiency can be improved," (paragraphs [0011] in detailed explanation of the invention of Patent Reference 1).

Further, the patent reference 1 proposes as follows. "A forming method of forming an adhesive surface of the mortar having the plurality of linear ridge-and-groove parts on the adhesive surface of the mortar to adhere the unit rock slab on the underlying surface comprises: forming evenly a plurality of linear wave shapes having the curvature without any sharp corners on the ridge part or the valley part as the forming end face of the trowel is contacted and slid on the upper surface of the mortal laid on the underlying surface; and placing and pressing the unit rock slab on the top of the thus-formed plurality of linear wave shapes as a level thereof is adjusted to the levels of the other plurality of rock slabs such that the rock slab is adhered. According to this feature, since the plurality of even and linear wave shapes having the curvature without sharp corners in the ridge part or the valley part as the forming end face of the trowel body is shifted while the forming end face is kept in contact with the upper surface of the mortar, the unit rock slab to be adhered to the upper surface of the mortar is positioned at the even level and an even adhesive surface without including air bubbles or the like in the mortar is formed as the mortar flows smoothly to the valley part without collapse of the mortar when the unit rock slab is placed and pressed such that the adhesive efficiency may be improved," (paragraphs in detailed explanation of the invention of Patent Reference 1).

PRIOR ART REFERENCE

Patent Reference

[Patent Reference 1] JP11-62211 (for example, Abstract, paragraphs [0001]-[0011] of the specification, FIGS. 1 to 3, etc.)

SUMMARY OF THE INVENTION

Problems to be Solved by the Invention

The trowel body disclosed in Patent Reference 1 surely has the forming die for forming evenly corrugated shape having the curvature without sharp corners in the ridge part or the valley part at least on the one side end part. The plurality of linear wave shapes (ridge-and-groove shape) having the curvature without sharp corners in the ridge part or the valley part are evenly formed by moving the forming end face of the trowel body (forming apparatus) as it is in contact with the upper surface of the mortar (adhesive substance) laid on the underlying surface (laying surface). Thus, the unit rock slab (tile) is placed and pressed on the upper part of the thus-formed plurality of linear wave shape (ridge-and-groove shape) such that the unit rock slab can be adhered. Here, the forming end face of the trowel body (forming apparatus) is moved as it is kept in contact with the upper surface of the mortar (adhesive substance) laid on the underlying surface (laying surface). And, when the forming end face of the trowel (forming apparatus) goes up and down all of a sudden, the upper surface of the mortar (adhesive substance) may be caused to wave or incline unexpectedly. Therefore, this may give rise to such a problem that a gap may be made between the tile and the adhesive substance and that the tile may be inclined unexpectedly.

It largely depends on the operator's skill for application work of the mortar (adhesive substance) with the trowel (forming apparatus) whether the forming end face of the above trowel (forming apparatus) is moved successfully or not. Therefore, there has been a problem that it is largely affected by the operator himself whether the upper surface of the mortar (adhesive substance) is good or not.

Therefore, it is an object to provide a forming apparatus for forming the upper surface of the adhesive substance in a ridge-and-groove shape such that it can be prevented or alleviated that the upper surface of the adhesive substance waves and that the inclination is unexpectedly caused.

Means for Solving the Problem

Provided is a forming apparatus (hereinafter, referred to as "present apparatus") of the present invention to form in a ridge-and-groove shape an upper surface of adhesive substance which adheres a tile and a laying surface on which the tile is laid. The forming apparatus comprises: tongue forming means having a plurality of tongues protruding from respective base ends thereof existing on a bottom defining line to respective tip ends thereof as free ends in each direction of protrusion, which is one of two directions parallel to a tongue existence plane and perpendicular to the bottom defining line as a line segment existing in the tongue existence plane of a flat surface, the plurality of tongues forming gaps therebetween, and a tongue securing portion securing the base ends of the plurality of tongues along the bottom defining line by fixing the base ends of the plurality of tongues to an edge portion of the tongue securing portion along the bottom defining line; grasping means directly or indirectly fixed to the tongue securing portion, the grasping means to be grasped by a user; and contact means directly or indirectly fixed to the tongue forming means and having at least two contact points contacting at least two points on a virtual plane of a flat surface perpendicular to the direction of protrusion, legs of perpendicular lines standing on the tongue existence plane from the at least two contact points or the at least two contact points themselves existing on a contact defining line of a line segment located on a protrusion direction side from the bottom defining line in the tongue existence plane.

The present apparatus is a forming apparatus to form the upper surface of the adhesive substance in a ridge-and-groove shape, which adheres a tile and a laying surface on which the tile is laid.

The present apparatus generally comprises the tongue forming means; the grasping means; and the contact means.

The tongue forming means comprises: the plurality of tongues, between adjacent two of which gaps are formed, and the tongue securing portion securing the base ends of the plurality of tongues. The bottom defining line is a virtual line segment existing in the tongue existence plane of a virtual plane. The direction of the protrusion is one of the two directions perpendicular to the bottom defining line parallel to the tongue existence plane. Every one of the plurality of tongues has a tip end as a free end protruding toward the protrusion direction and a base end secured to the tongue securing portion along the bottom defining line such that the tip end of the free end protrudes towards the protrusion direction from the base end existing on the bottom defining line. The tongue securing portion secures each base end of each tongue along the bottom defining line as respective base ends of the plurality of tongues are fixed to the edge portion of the tongue securing portion along the bottom defining line such that gaps are formed between the plurality of tongues.

The grasping means is directly or indirectly fixed to the tongue securing portion of the tongue forming means and is grasped by the user of the present apparatus when the present apparatus is used.

The contact means is directly or indirectly fixed to the tongue forming means. The contact means has at least two contact points contacting at least two points on a virtual plane (a surface assumed as the laying surface on which tiles are laid) of a flat surface perpendicular to the protrusion direction. And legs of the perpendicular lines extending to the tongue existence plane of the at least two contact points (when the at least two contact points does not exist on the tongue existence plane) and the at least two contact points approximately exist on the contact defining line existing on the tongue existence plane (when the at least two contact points exists on the tongue existence plane). The contact defining line is a line segment (virtually) existing on the protrusion side from the bottom defining line in the tongue existence plane.

According to use of the present apparatus, the present apparatus is moved over the laying surface (virtual surface) on which the adhesive substance is laid (the present apparatus is moved with respect to the adhesive substance applied onto the laying surface) as the contact means is kept in contact with the laying surface (virtual surface) such that the adhesive substance passes the gaps between the plurality of tongues. Thus, the upper surface of the adhesive substance applied on the laying surface can be formed in the ridge-and-groove shape corresponding to the respective gaps between the plurality of tongues. The upper surface (ridge portion) of the ridge-and-groove formed by the base ends of the plurality of tongues of the tongue forming means fixed directly or indirectly to the contact means contacting the laying surface (virtual surface) has a position (normally height) determined relatively to the laying surface (virtual surface) in accordance with the distance between the bottom defining line and the contact defining line. Therefore, according to use of the present apparatus, it can be prevented or alleviated that the upper surface (an upper surface of a ridge (ridge portion)) of the adhesive substance waves or has an unintended inclination.

With respect to the present apparatus, the apparatus (hereinafter, referred to as "passing gap changing main device") may comprise passing gap changing means which changes orthographic projection of each of the passing gaps which is open in both directions perpendicular to the tongue existence plane, the passing gaps existing between the bottom defining line and the contact defining line.

The passing gaps exist between the bottom defining line and the contact defining line in the tongue existence plane. The passing gaps are open in both directions perpendicular to the tongue existence plane (the gaps are space through which straight lines perpendicular to the tongue existence plane pass (but none of the straight lines hit any part of the present apparatus)). A cross-section shape (a cross-section shape on the tongue existence plane) of the adhesive substance applied on the laying surface is formed in a shape (including the ridge-and-groove shape) corresponding to shapes of the passing gaps by making the adhesive substance passing through the passing gaps. Therefore, the cross-section shape (including the ridge-and-groove shape) of the adhesive substance applied on the laying surface is made suitable in accordance with conditions and so on for laying tiles by changing the orthographic projection of each of the passing gaps on the tongue existence plane with the passing gap changing means.

In the case of a passing gap changing main device, the passing gap changing means is constituted of what the contact means configures (hereinafter, referred to as "protrusion status changing main device") including an additional contact portion which can be in both conditions: a protrusion condition in which legs of the perpendicular lines extending to the tongue existence plane from the at least two contact points or the at least two contact points themselves exist beyond a tip end portion toward the protrusion direction; and a non-protrusion condition in which the legs of the perpendicular lines extending to the tongue existence plane from the at least two contact points or the at least two contact points themselves exist in a counter direction opposite to the protrusion direction from a minimum protrusion tip end portion which is located at one position of the most opposite direction among the positions where the tip end portions of the plurality of the tongues exist to the protrusion direction or at the same one position as that of the minimum protrusion tip end portion in the protrusion direction.

The additional contact portion can be in one of both conditions: a protrusion condition in which legs of the perpendicular lines extending to the tongue existence plane from the at least two contact points contacting at least two points in the virtual plane (a surface assumed as the laying surface on which tiles are laid) (when the at least two contact points does not exist on the tongue existence plane), or the at least two contact points themselves exist beyond any one of the tip end portions of the plurality of tongues toward the protrusion direction (when the at least two contact points exists on the tongue existence plane); and a non-protrusion condition in which the legs of the perpendicular lines extending to the tongue existence plane from the at least two contact points contacting at least two points in the virtual plane, or the at least two contact points themselves exist in a counter direction opposite to the protrusion direction from the minimum protrusion tip end portion which is located at the one position of the most opposite direction among the positions where the tip end portions of the plurality of the tongues exist to the protrusion direction or at the same one position as that of the minimum protrusion tip end portion in the protrusion direction. Therefore, the contact point of the additional contact portion contacts the virtual surface (laying surface) in the protrusion condition such that the tip ends of the plurality of tongues may separate from the virtual surface (laying surface) and that an adhesive substance layer may be formed on the virtual surface (laying surface) in a valley part of the ridge-and-groove shape (formed by tip ends of a plurality of tongues) formed on the upper surface of the adhesive substance. Further, in the non-protrusion condition of the additional contact portion, tip ends of the plurality of tongues contact the virtual surface (laying surface) and the adhesive substance on the virtual surface (laying surface) in the valley part (formed by tip ends of the plurality of tongues) of the ridge-and-groove shape formed on the upper surface of the adhesive substance can be removed.

That is, since the contact means including the additional contact portion constitutes the passing gap changing means as mentioned above, it is possible to choose existence or non-existence of the adhesive substance layer or thickness of the layer on the virtual surface (laying surface) in the valley part of the ridge-and-groove shape formed on the upper surface of the adhesive substance.

With respect to a protrusion status changing main device (hereinafter, referred to as "screw additional contact member main device"), the additional contact portion is constituted by including a male screw member having male thread inscribed on an inner surface thereof to engage with the male thread. One of the male screw member and female screw member is directly or indirectly fixed to the tongue forming means and the other of the male screw member and female screw member is turned in a normal direction or a reverse direction relatively to the one such that an end part existing on a protrusion direction side of the other is displaced to have a displacement component in the protrusion direction. The end part existing on the other protrusion direction side may be at least one of the at least two contact points.

With such a simple configuration (the present apparatus can be configured easily and inexpensively) constituted of the male screw member and the female screw member, which engage with each other, the one of the male screw member and female screw member is directly or indirectly fixed to the tongue forming means such that the other of the male screw member and female screw member is turned in the normal direction or the reverse direction relatively to the one such that the end part existing on the protrusion direction side of the other is displaced to have the displacement component in the protrusion direction. Thus, the end part existing on the protrusion side of the other being displaced to have the component in the protrusion direction.

With respect to a screw additional contact member main device, in the case where the end part on the protrusion direction side of the female screw member is located on the protrusion direction side of the male screw member, the screw additional contact member main device may comprise a closing valve with which the end part on the protrusion direction side of the female screw member is closes and the end part on the protrusion direction side of the male screw member is allowed to stick out of or retreat from the end part of the projection direction of the female screw member.

In the screw additional contact member main device, the end part existing on the protrusion direction of the other among the male screw member and the female screw member, which constitute the screw additional contact member main device, is displaced relative to the one (directly or indirectly attached to tongue forming means) such that the end part may have a component in the protrusion direction. Since the end part on the protrusion direction of the female screw member faces the adhesive substance and is stuck into the adhesive substance, some of the adhesive substance may enter inside the female screw member from the end part of on the protrusion direction side of the female screw member and adhere to the threaded female screw (it is likely to have trouble in removing hardened adhesive substance attached to the female screw). Therefore, when the end part on the protrusion direction side of the female screw member is located on the protrusion direction side from the end part on the protrusion direction side of the male screw member (that is, when the end part of the female screw member on the protrusion direction side is not plugged by the male screw member), the closing valve member may be comprised of such that the end part on the protrusion direction side of the female screw member is closed and the end part on the protrusion direction side of the male screw member is allowed to stick out of and retreat from the end part on the protrusion direction of the female screw member. Thus, the end part on the protrusion direction side of the male screw member can freely stick out and retreat from the end part on the protrusion direction side of the female screw member and the end part on the protrusion direction side of the female screw member can be closed by the closing valve when the end part on the protrusion direction side of the female screw member is not closed with the male screw member. Therefore, it is possible to prevent or alleviate to some degree that the adhesive substance enters into the interior of the female screw member from the end part on the protrusion direction of the female screw member.

With respect to the screw additional contact member main device, a finger grip portion may be provided to the male screw member projecting from the female screw member in an opposite direction to the protrusion direction such that force to turn the male screw member is applied thereto.

It may be performed in various ways to turn the other of the male screw member and the female screw member which constitute the screw additional contact member main device in the normal direction or the reverse direction relative to the one. For example, a method of turning it by an electric motor or the like with electric power, a method of turning it manually with a hand of the user of the present apparatus, and so on can be named. In particular, the present apparatus may be simply and inexpensively configured with the method of turning it manually by the hand of the user of the present apparatus since the electric motor or the like is not necessary. Further, in the case of turning it manually with the hand of the user of the present apparatus, it would become convenient to use the present apparatus since tools such as spanner, screw driver, wrench, and so on are not necessary if the finger grip is provided to apply force to turn the male screw member to part of the male screw member protruding toward the opposite direction to the protrusion direction from the female screw member.

With respect to the passing gap changing main device, the passing gap changing means (hereinafter, referred to as "gap width adjusting main device") may comprise gap width adjusting means to close the gap in a parallel direction to the bottom defining line, which is formed between the plurality of tongues.

If the gap width adjusting means included by the passing gap changing means can close (movement of the adhesive substance across the tongue existence plane is prohibited) gaps formed between the plurality of tongues in a parallel direction to the bottom defining line such that the gap width (size in a parallel direction to the bottom defining line) can be adjusted, it is possible to adjust the width of the ridge appearing in the cross section (cross-section shape on the tongue existence plane) of the adhesive substance applied on the laying surface.

With respect to a gap width adjusting main device, the gap width adjusting means (hereinafter, referred to as "width adjusting member main device") can close at least partially the gap formed between the plurality of tongues and may comprise a width adjusting member disposed slidably along the bottom defining line relative to the gap. Since it is simply configured to dispose the width adjusting member slidably along the bottom defining line relative to the gap formed between the plurality of tongues as mentioned above, it is possible to adjust the width of gap (size in a parallel direction to the bottom defining line) formed between the plurality of tongues by closing (movement of the adhesive substance across the tongue existence plane is prohibited) at least partially in a parallel direction to the bottom defining line.

With respect to a width adjusting member main device, the width adjusting member may be a plate member having a notch formed in approximately the same shape of the gap formed between the plurality of tongues.

In this way, it is possible to adjust widths of a plurality of gaps (size in a parallel direction to the bottom defining line) formed between the plurality of tongues by sliding the plate member as the width adjusting member along the bottom defining line relatively with respect to the gaps formed between the plurality of tongues.

With respect to the passing gap changing main device, the passing gap changing means (hereinafter, referred to as "variable weir main device") may comprise variable weir means to close the gaps formed between the plurality of tongues with a variable width toward the protrusion direction from the bottom defining line.

If the height of the gap (size toward the protrusion direction) can be adjusted by closing (movement of the adhesive substance across the tongue existence plane is prohibited) the gaps formed between the plurality of tongues with variable width (size in the protrusion direction) from the bottom defining line toward the protrusion direction, the variable weir means included by the passing gas changing means can adjust the height (height from the laying surface) of the ridge appearing on the cross-section shape (cross-section shape on the tongue existence plane) of the adhesive substance applied to the laying surface.

With respect to a variable weir main device, the variable weir means may comprise (hereinafter, referred to as "variable weir main device") a weir member in a belt shape, a main surface of which can slide freely with respect to the tongue forming means in the protrusion direction and an opposite direction thereto and in approximately parallel to the tongue existence plane, such that the weir member closes the plurality of gaps formed between the plurality of tongues.

In this way, the belt-like weir member to close the plurality of gaps formed between the plurality of tongues over the bottom defining line direction is disposed such that a main surface of the weir member is approximately parallel to the tongue existence surface, and is configured to freely slide relatively with respect to the tongue forming means in the protrusion direction and an opposite direction thereto. In this way, the heights (size toward the protrusion direction) of the plurality of gaps formed between the plurality of tongues can be adjusted and the heights (height from the laying surface) of the ridge appearing on the cross-section shape (cross-section shape on the tongue existence plane) of the adhesive substance applied to the laying surface can be adjusted easily.

With respect to a weir member main device, an edge portion on the protrusion direction side of the weir member is formed along the line segment and the weir member may slide such that the angle between a straight line including an orthographic projection of the edge portion of the protrusion side of the weir member on the tongue existence plane and a straight line including the bottom defining line may be variable.

In this way, the weir member slides such that the inclination (an angle between a straight line including an orthographic projection of the edge portion of the protrusion direction side of the weir member on the tongue existence plane and a straight line including the bottom defining line) of the edge portion of the protrusion side of the weir member formed along the line segment is variable to the plurality of the tongues and hence the inclination of the upper surface of the ridge appearing on the cross-section shape (cross-section shape on the tongue existence plane) of the adhesive substance applied to the laying surface can be adjusted.

With respect to the present device, the contact means may comprise at least two or more edge portions of the plurality of tongues.

In this way, the end portions of the tongues can serve as the at least two contact points (at least two contact points contacting at least two points on a virtual plane) of the contact means such that the present device can be so configured that the end portion contacts the virtual surface (laying surface). Here, in this case, the adhesive substance on the virtual surface (laying surface) in the valley parts of the ridge-and-groove shape of the adhesive substance formed by the end portions of the tongues serving as the at least two contact points is removed.

With respect to the present device, the grasping means may be freely attached to and detached from the tongue forming means.

The tongue forming means having the plurality of tongues forms a ridge-and-groove shape corresponding to the gaps between the plurality of tongues on the upper surface of the adhesive substance applied on the laying surface by passing the adhesive substance through the gaps between the plurality of tongues such that the tongue forming means may be configured to be exchangeable depending on the desired ridge-and-groove shape. For example, a plurality of kinds of tongue forming means may be attachable to one grasping means (the grasping means is freely attached to and detached from the tongue forming means) such that the one grasping means can be used with various kinds of tongue forming means attached thereto.

With respect to the present device, a front rising wall member formed separately from the grasping means may be comprised of such that an orthographic projection of an outer surface of the grasping means on the tongue existence plane, which has at least a portion appearing on an opposite direction to the protrusion direction from the bottom defining line overlapping the orthographic projection on the tongue existence plane, may rise in the opposite direction to the protrusion direction.

The front rising wall member is formed separately from the grasping means such that the member may rise in the opposite direction to the protrusion direction such that at least portion of part appearing in the opposite direction to the protrusion direction from the bottom defining line in the orthographic projection on the tongue existence plane of the outer surface of the grasping means may overlap an orthographic projection of the front rising wall member on the tongue existence plane. In this way, the front rising wall member is provided. Hence, the present apparatus is moved such that the front rising wall member exists in the front direction of the traveling direction over the laying surface (virtual surface) on which the adhesive substance is disposed as the contact means of the present apparatus is kept in contact with the laying surface (virtual surface) and the upper surface of the adhesive substance applied on the laying surface is formed in the ridge-and-groove shape by passing the adhesive substance through the gaps of the plurality of tongues. Then, it is possible to prevent the adhesive substance from adhering to the grasping means since the front rising wall member plows the adhesive substance.

With respect to the present apparatus, a stand which can have the forming apparatus stand by itself may be provided thereto such that a tip end of the stand contacts on the horizontal virtual surface.

In this way, since the present apparatus can stand by itself on the laying surface (virtual surface) (for example, the present apparatus may be configured to stand by itself by making a tip end of the stand contact on the laying surface (virtual surface)), it is possible to let the present apparatus stand by itself when the present apparatus is not used in the middle of operation with the present apparatus. It is possible to prevent or alleviate that the adhesive substance may adhere to the present apparatus unexpectedly if compared with the case of letting the present apparatus lie around on the laying surface (virtual surface).

With respect to the present apparatus, means for checking the horizontal level may be provided thereto in order to check if the bottom defining line is horizontal or not.

It is often required that the upper surface of the ridge (ridge portion) of the ridge-and-groove shape formed on the upper surface of the adhesive substance applied on the laying surface is constructed horizontally among the ridges adjacent to the subject ridge. For this reason, the means for checking the horizontal level may be provided thereto in order usually to check if the bottom defining line which defines the upper surfaces of the adjacent ridges (ridge portions) is horizontal or not. As the means for checking the horizontal level, various kinds of devices can be utilized such that they are not limited thereto, but a bubble tube (level) or the like which is attached in parallel to the bottom defining line can be named.

With respect to the present apparatus, the grasping means may comprise a grasping bar shaped in a bar shape extending approximately in parallel to the bottom defining line.

In the case where the upper surface of the adhesive substance applied on the laying surface is formed in the ridge-and-groove shape by moving the present apparatus over the laying surface (virtual surface) on which the adhesive substance is provided thereto as the contact means of the present apparatus is kept in contact with the laying surface (virtual surface) such that the adhesive substance is passed through the gaps between the plurality of tongues, the present apparatus can be surely grasped and moved easily by the user of the present apparatus. From this, the grasping means may comprise a grasping bar of a bar shape extending approximately in parallel to the bottom defining line such that the user of the present apparatus may grasp the grasping bar with the user's hand.

Further, the present invention may provide a forming method (hereinafter, referred to as "present method") utilizing the present apparatus to form the upper surface of the adhesive substance applied on the laying surface in the ridge-and-groove shape.

The present method is a forming method of forming an upper surface of adhesive substance applied on a laying surface in a ridge-and-groove shape. The present method comprises: a providing step of providing the adhesive substance on the laying surface; and a shape forming step of forming the ridge-and-groove shape corresponding to gaps between a plurality of tongues by passing the adhesive substance through the gaps between the plurality of tongues as the present forming apparatus is moved over the laying surface on which the adhesive substance is provided in the providing step as contact means is kept in contact with the laying surface.

The present method comprises: a proving step of proving the adhesive substance on the laying surface; and a shape forming step of forming the ridge-and-groove shape on the upper surface of the adhesive substance provided in the providing step. In the providing step, the adhesive substance is provided onto the laying surface (for example, applied thereto). In the shape forming step, the present apparatus is moved over the laying surface as the contact means (contact point) is kept in contact with the laying surface on which the adhesive substance is provided thereto in the providing step such that the adhesive substance is passed through gaps between the plurality of tongues such that a ridge-and-groove shape corresponding to gaps between the plurality of tongues is formed. In this way, the upper surface of the adhesive substance applied onto the laying surface is formed in the ridge-and-groove shape. The upper surface of the ridge (ridge portion) formed by base ends of the plurality of tongues of the tongue forming means fixed directly or indirectly to the contact means of the present apparatus contacting the laying surface (virtual surface) is determined to be positioned at a position (normally height) relative to the laying surface (virtual surface) corresponding to the distance between the bottom defining line and the contact defining line. Hence, according to the present method, it is possible to prevent or alleviate that the upper surface (the upper surface (ridge portion) of the ridge-and-groove) of the adhesive substance waves and is subject to an unintended inclination.

With respect to the present method, the protrusion status changing main device may be utilized as the present device and the shape forming step may be conducted while the additional contact portion is in a protrusion condition.

In this way, the shape forming step is conducted while the additional contact portion is in the protrusion condition such that end portions of the plurality of tongues are apart from the virtual surface (laying surface) as a contact point of the additional contact portion is in contact with the virtual surface (laying surface), and an adhesive substance layer can be formed on the virtual surface (laying surface) in valley portions (formed by tip ends of a plurality of tongues) of the ridge-and-groove shape formed on the upper surface of the adhesive substance (the laying surface and the tile can be surely bonded by forming the adhesive substance layer at any area on the virtual surface (laying surface)).

BRIEF DESCRIPTIONS OF THE DRAWINGS

DETAILED EXPLANATION TO IMPLEMENT THE INVENTION

In the following, the detailed explanation of examples of the present invention is made with reference to the drawings. However, the present invention is not limited thereto.

Figure 1:
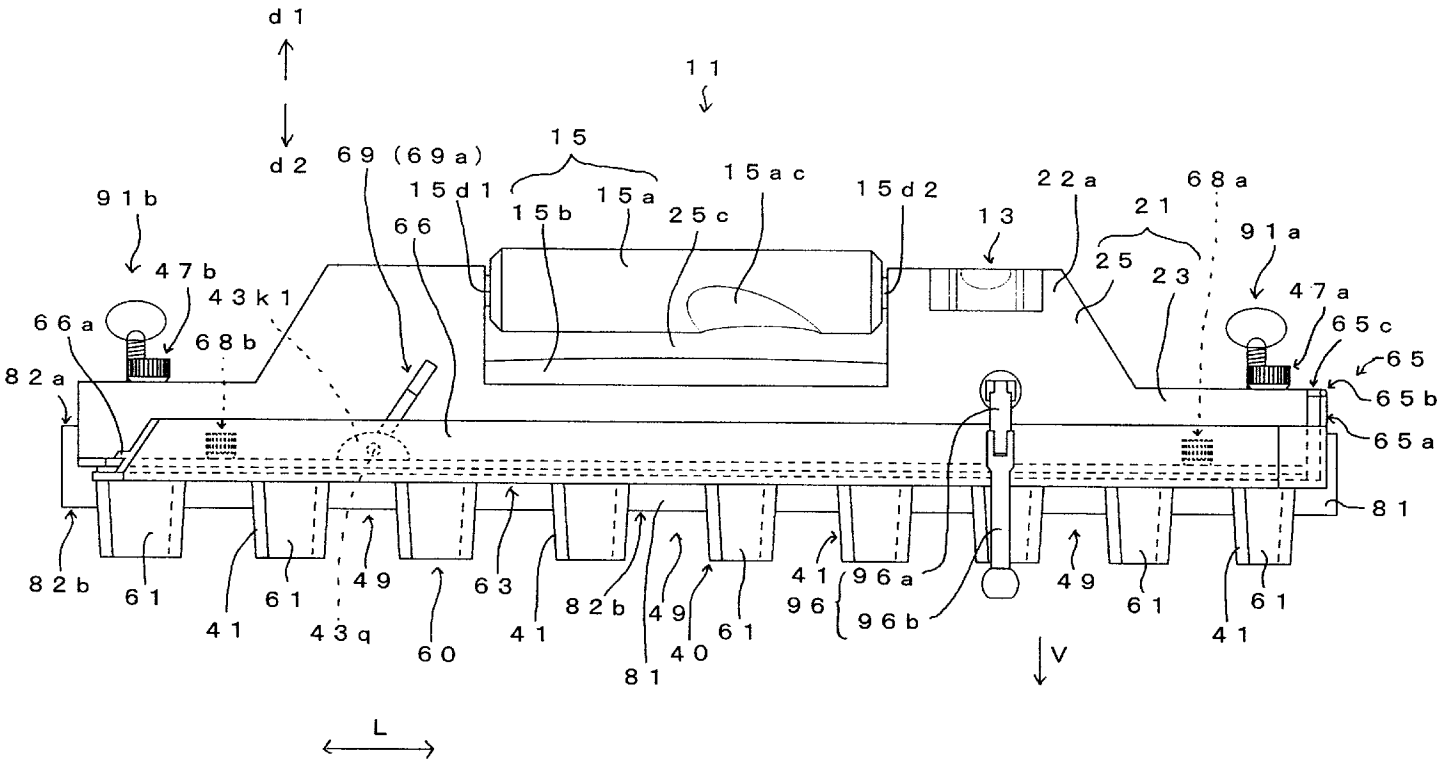
FIG. 1 is a front view showing a forming apparatus (present apparatus) of one embodiment according to the present invention.
Figure 2:
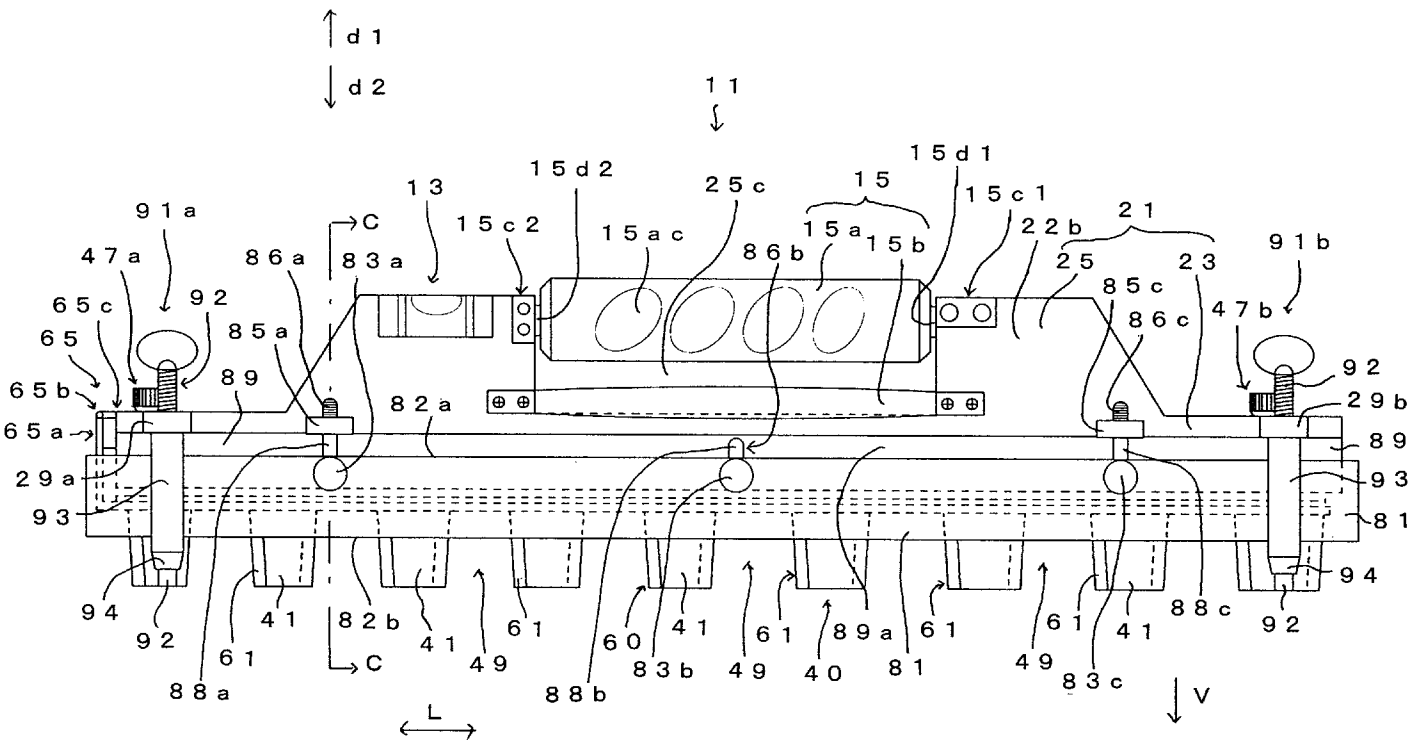
FIG. 2 is a rear view of the present apparatus as shown in FIG. 1.

FIG. 1 is a front view showing a forming apparatus (present apparatus) of one embodiment of the present invention; FIG. 2 is a rear view of the present apparatus of FIG.

Figure 3:
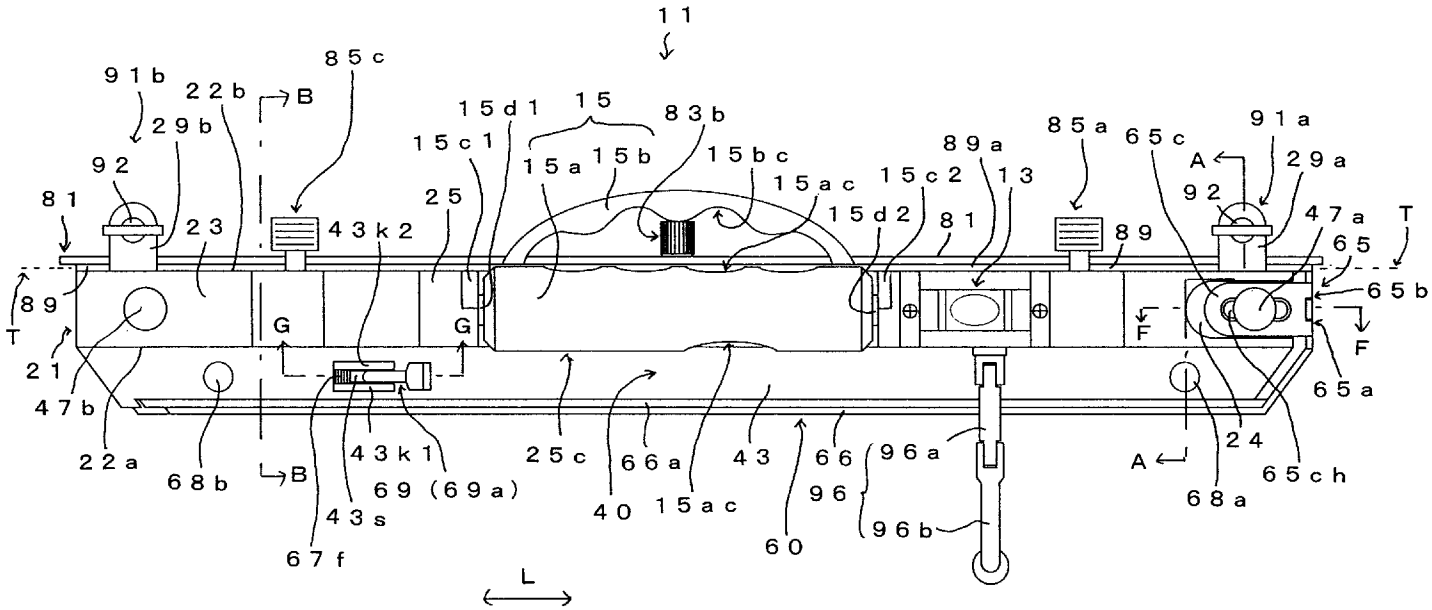
FIG. 3 is a plan view of the present apparatus as shown in FIG. 1.
Figure 4:
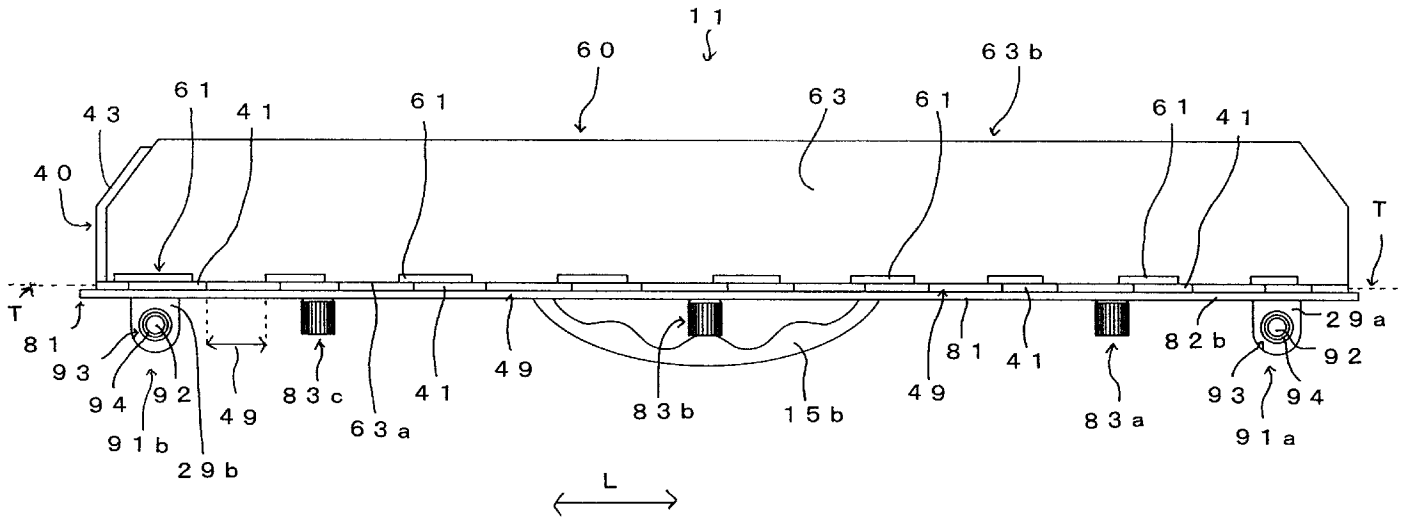
FIG. 4 is a bottom view of the present apparatus (in a condition where a stand is removed) as shown in FIG. 1.
Figure 5:
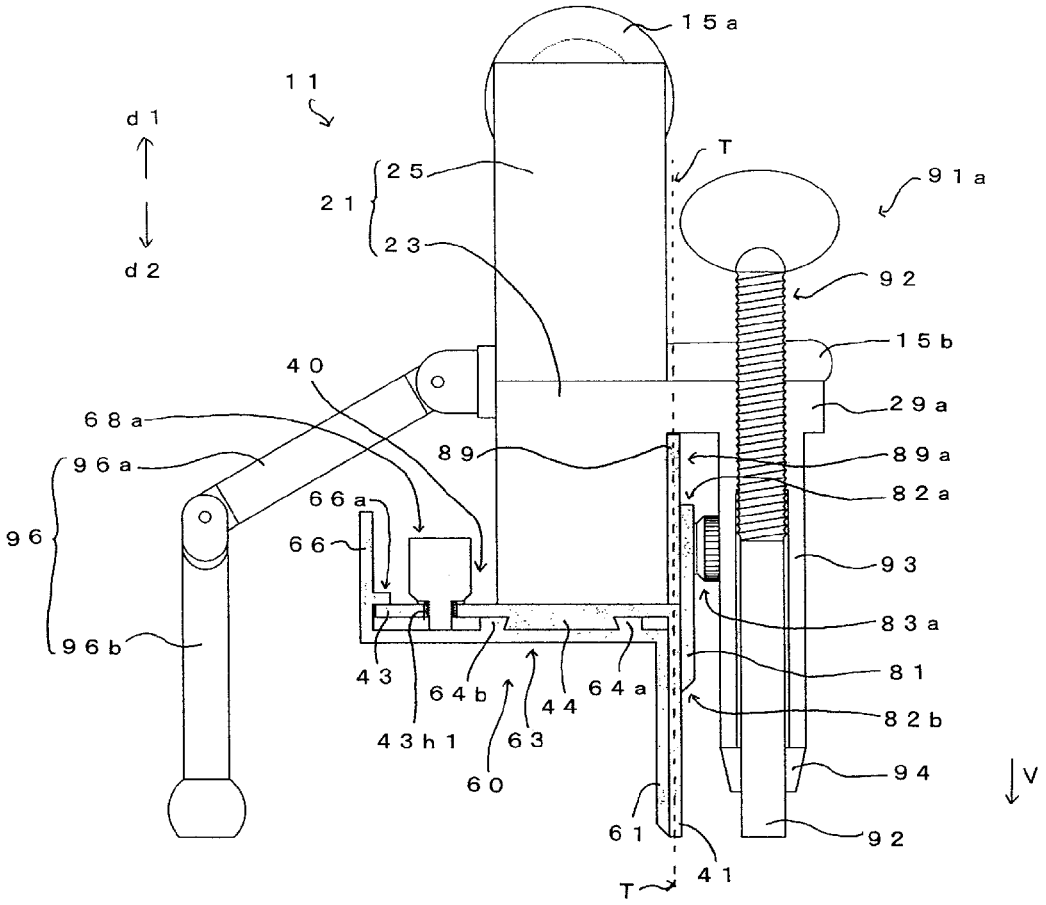
FIG. 5 is a cross-section view along A-A line of FIG. 3.
Figure 6:
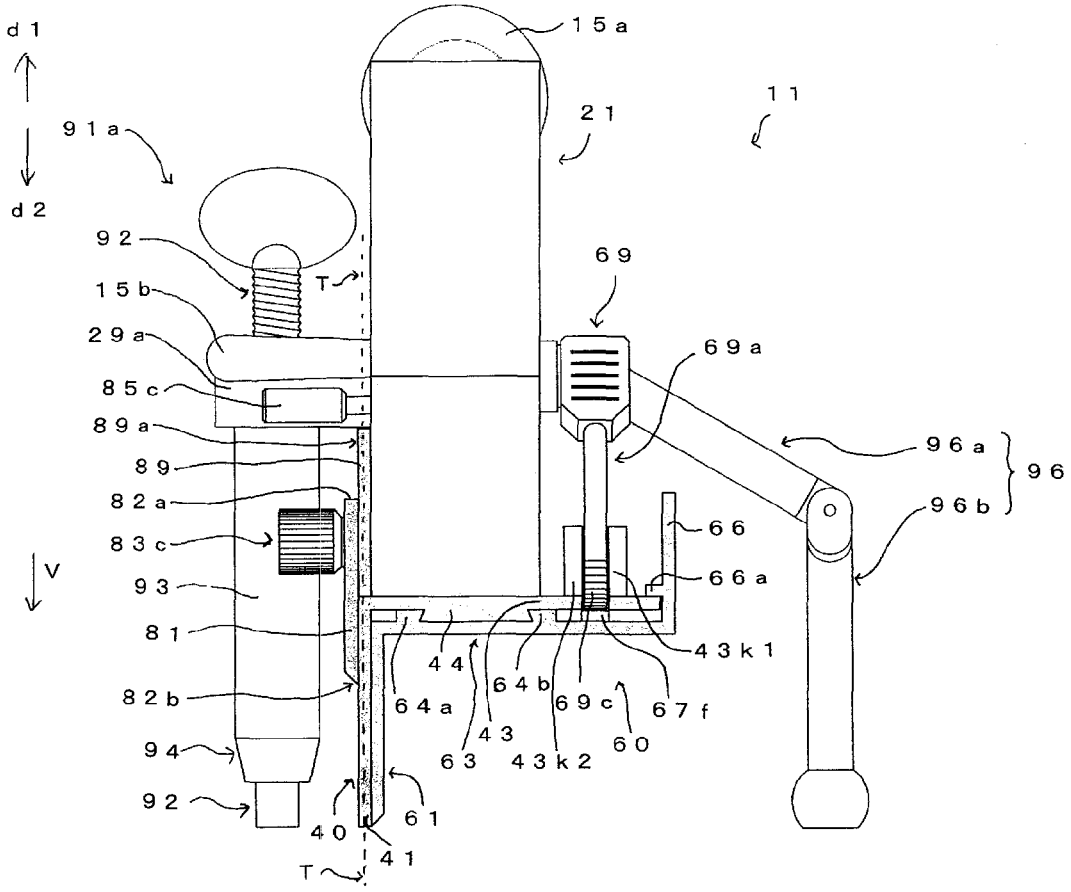
FIG. 6 is a cross-section view along B-B line of FIG. 3.
Figure 7:
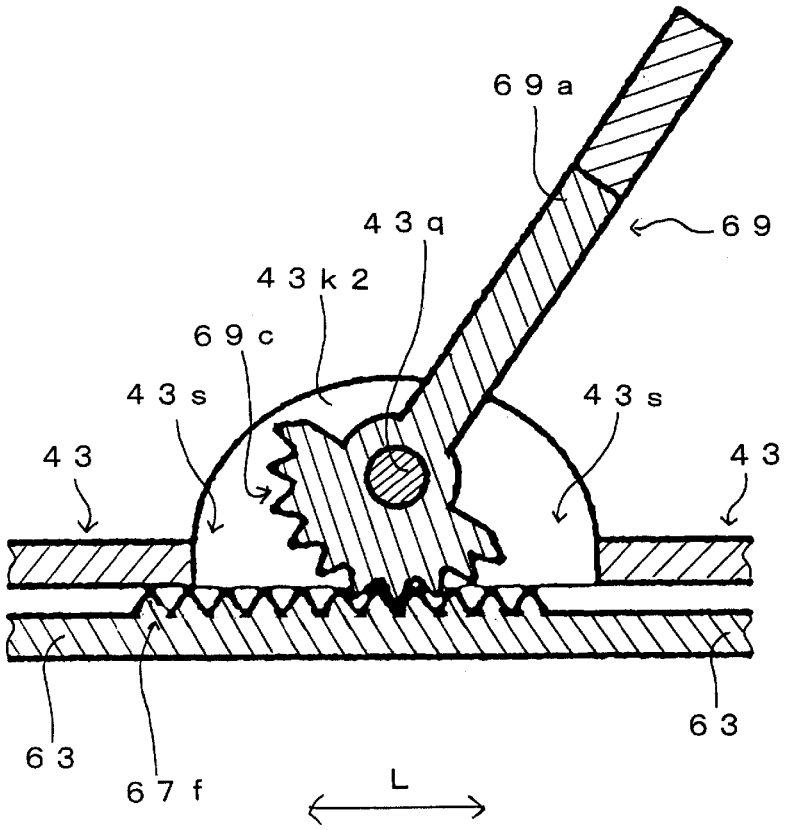
FIG. 7 is a cross-section view (partial cross-section view) along G-G line of FIG. 3.
Figure 8:
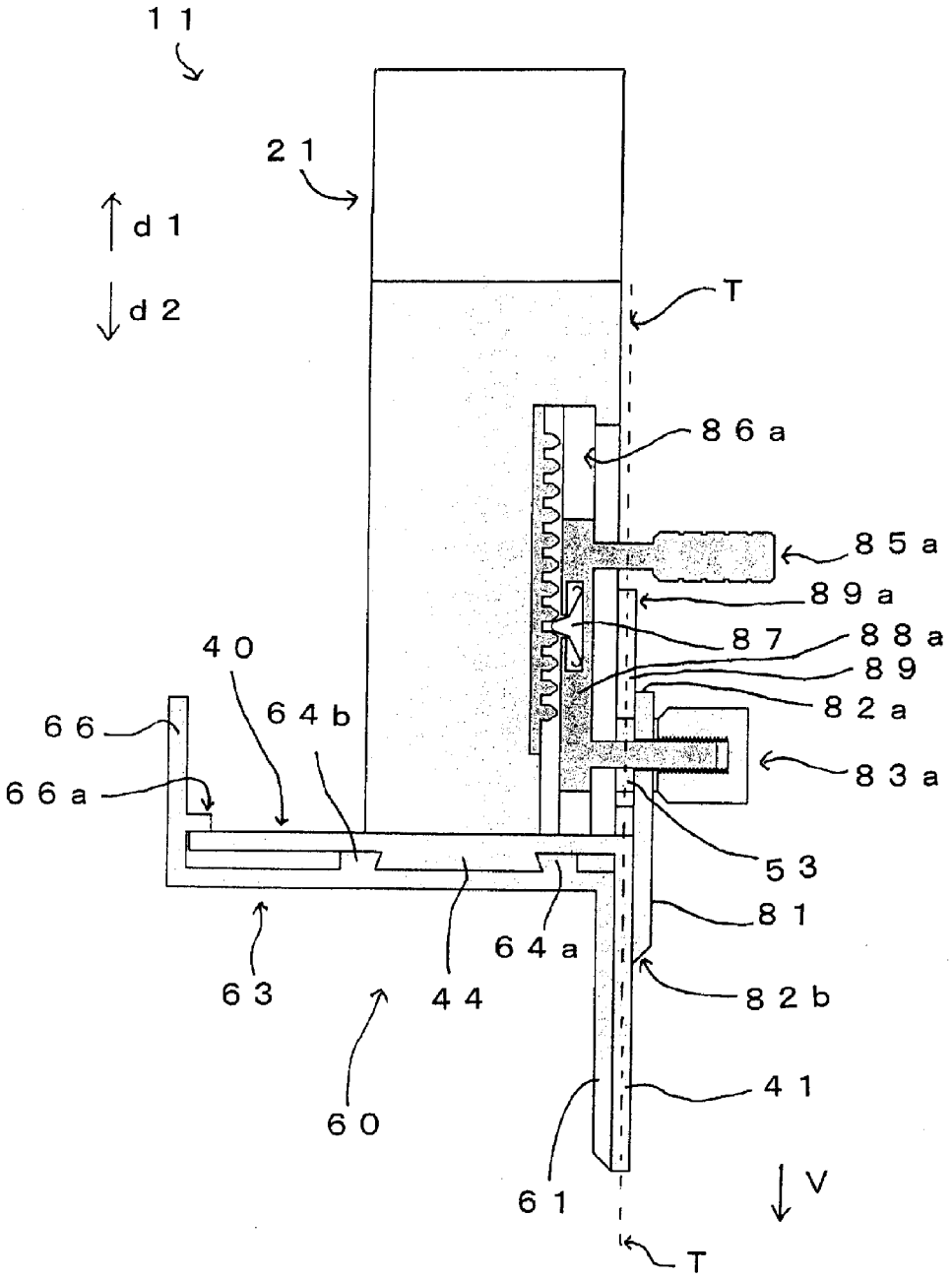
FIG. 8 is a cross-section view (some parts are omitted from the view) along C-C line of FIG. 2.

2; FIG. 3 is a plan view of the present apparatus of FIG. 3; FIG. 4 is a bottom view (here, it shows a state that the stand 96 to be described later is removed) of the present apparatus; FIG. 5 is a cross-section view along A-A line of FIG. 3; FIG. 6 is a cross-section view along B-B line of FIG. 3; FIG. 7 is a cross-section view along G-G line of FIG. 3; and FIG. 8 is a cross-section view along C-C line of FIG. 2 (here, the stand 96 to be described later, the grasping portion 15*a*, and the like are not shown). The present apparatus 11 is explained with reference to FIGS. 1 to 8.

The present apparatus 11 generally comprises: a main body 21 formed with a plate member with a large thickness (here, it is made of wood); a securing portion 40 fixed to the main body 21; a lateral slide portion 60 fixed to the main body 21; a vertical slide edge 81 fixed to the main body 21; a height adjusting part 91 (a pair of height adjusting parts 91*a*, 91*b* are included) fixed to the main body 21; and a stand 96 fixed to the main body 21. Here, "up" and "down" means an upper direction in a vertical direction and a lower direction in the vertical direction when the main surfaces of tongues 41 and tongues 61 to be described later represent a vertical flat surface as the present apparatus 11 is place on a horizontal plane and arrow d1 (Up) and arrow d2 (down) indicate such directions in the figures.

The main body 21 comprises a main body lower portion 23 of a rectangular bar extending along the longitudinal direction and a main body upper portion 25 formed together with the main body lower portion 23 wherein the main body is formed integrally with wood member. At approximately a center position in the longitudinal direction of the main body upper portion 25, a grasping portion 15 is provided for a user (not shown) of the present apparatus 11 to grasp it. The grasping portion 15 includes a bar-shaped grasping portion 15*a* (in order to prevent hands from slipping, it is formed with flexible rubber material and, in addition, a recess 15*ac* is formed such that a finger of a hand surely engages with it) formed in an approximately circular cylindrical shape extending along a longitudinal direction L and fixed to the main body upper portion 25 in a freely-attachable-and-detachable manner; and a finger catch 15*b* (made of hard synthetic resin. a convex-and-concave portion 15*bc* is formed along the edge portion according to the shape of the finger such that the finger may readily engage) with which fingers of a hand surely engages when the grasping portion 15*a* is grasped by the hand. Here, the main body upper portion 25 is provided with a notch 25*c* which can just accommodate the grasping portion 15*a* and the grasping portion 15*a* is provided with fixing brackets 15*d*1, 15*d*2 on both end sides along the longitudinal direction L. Engaging parts 15*c*1, 15*c*2 which is freely engageable and disengageable with the fixing brackets 15*d*1, 15*d*2 of the grasping portion 15*a* accommodated in the notch 25*c* are arranged in the notch 25*c* of the main body upper portion 25. The engaging parts 15*c*1, 15*c*2 engages with the fixing brackets 15*c*1, 15*c*2 such that the grasping portion 15*a* may be fixed to the main body 21 (main body upper portion 25). The engaging parts 15*c*1, 15*c*2 release the engagement with the fixing brackets 15*c*1, 15*c*2 such that the grasping portion 15*a* may be removed from the main body 21 (main body upper portion 25). Thus, the grasping portion 15*a* is freely attachable and detachable for the replacement.

On an upper portion (at a position adjacent to the grasping portion 15) of the main body 21 (main body upper portion 25), a bubble tube level 13 is arranged. The bubble tube level 13 is utilized to confirm that the present apparatus 11 (longitudinal direction L) is horizontal.

Figure 10A:
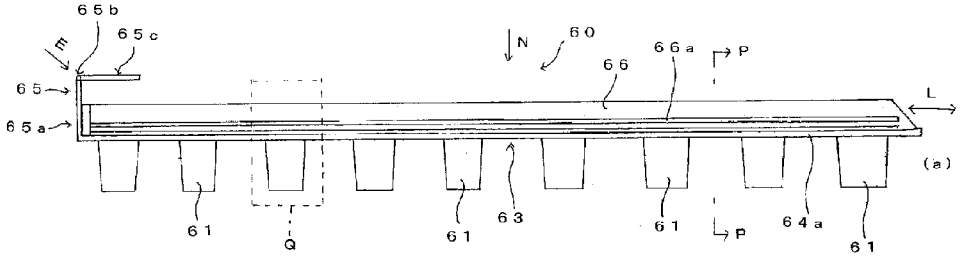
FIG. 10A is a diagram (rear view) showing a lateral slide portion.
Figure 10B:
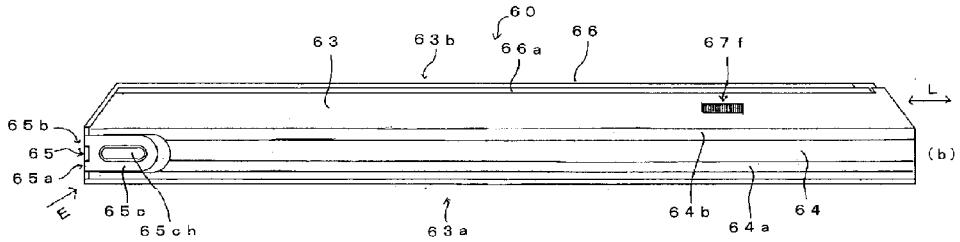
FIG. 10B is a diagram (plan view) showing the lateral slide portion.
Figure 11A:
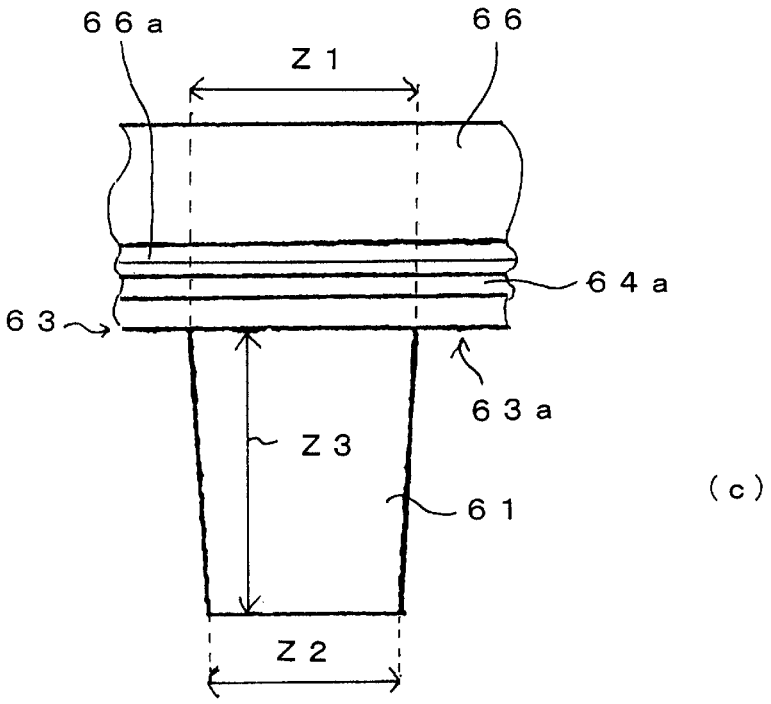
FIG. 11A is a diagram (enlarged view of Q in FIG. 10A) mainly illustrating details of a tongue of a securing portion and a tongue of the lateral slide portion.
Figure 11B:
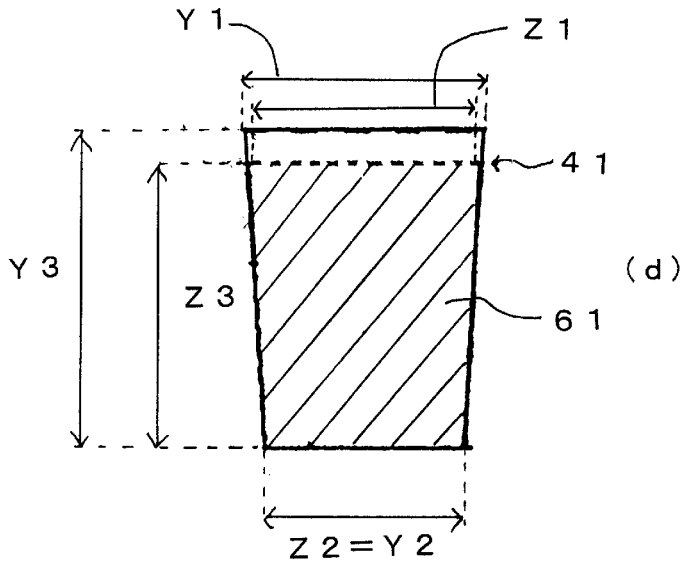
FIG. 11B is a diagram mainly illustrating details of the tongue of the securing portion and the tongue of the lateral slide portion.
Figure 12A:
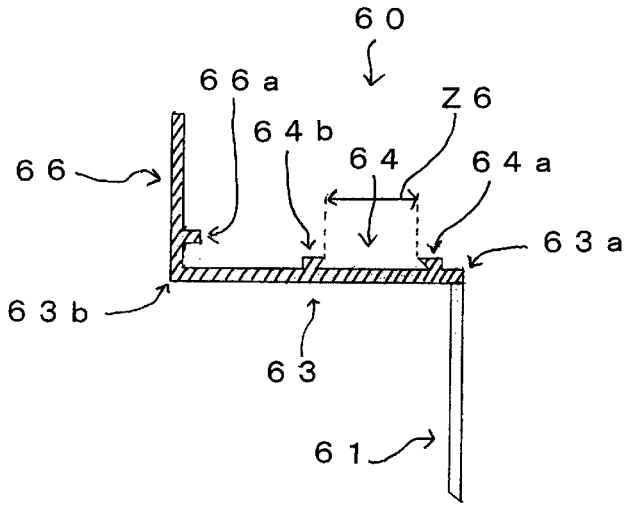
FIG. 12A is an enlarged cross-section view (cross-section view along P-P line in FIG. 10A) of the lateral slide portion.
Figure 12B:
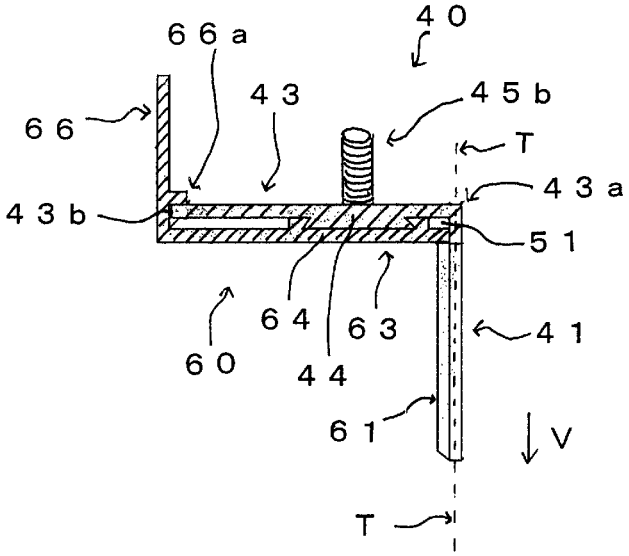
FIG. 12B is an enlarged cross-section view of the securing portion and the lateral slide portion.
Figure 13A:
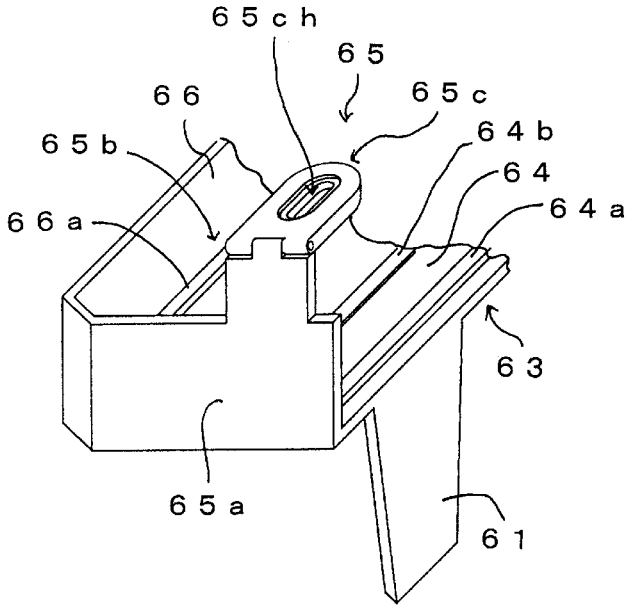
FIG. 13A is a partial perspective view of the lateral slide portion indicated by arrow E of FIG. 10A.
Figure 13B:
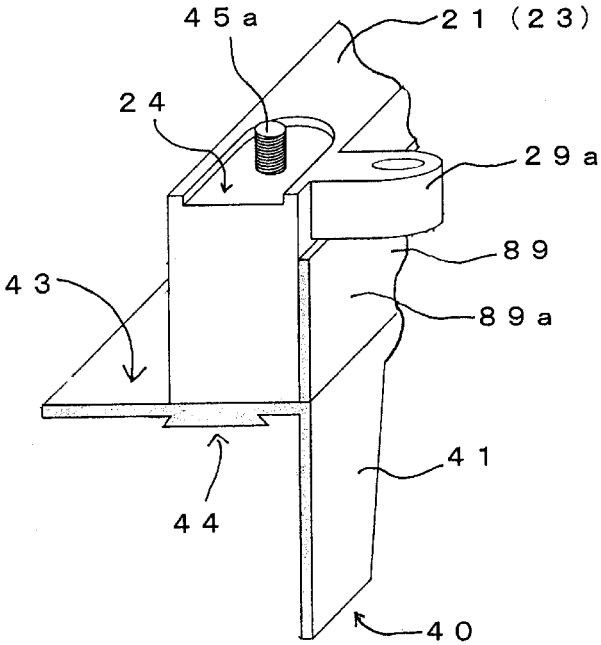
FIG. 13B is a partial enlarged view of a main body (lower part of the main body) and the securing potion engaging with a portion of the lateral slide portion as shown in FIG. 13A.
Figure 14:
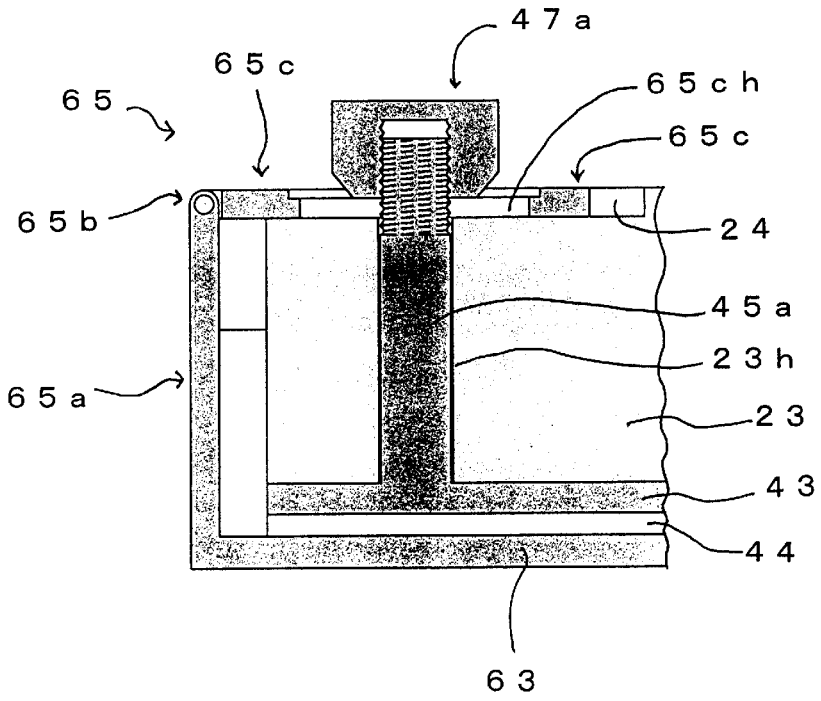
FIG. 14 is a cross-section view along F-F line of FIG. 3.

Next, with respect to the securing portion 40 and the lateral slide portion 60, explanation will be made with reference to FIGS. 9A, 9B, 9C, 9D, 10A, 10B, 11A, 11B, 12A, 12B, 13A, 13B, and 14. FIGS. 9A-9D are diagrams showing the securing portion 40. FIGS. 10A-10B are diagrams showing the lateral slide portion 60. FIGS. 11A-11B are diagrams illustrating mainly details of a tongue 61 and a tongue 41. FIGS. 12A-12B are enlarged cross-section views showing the securing portion 40 and the lateral slide portion 60. FIG. 13A is a perspective view of part of the lateral slide portion 60, which is indicated by the arrow E in FIG. 10A. FIG. 13B is a partial enlarged view of the main body 21 (main body lower portion 23) and the securing portion 40 engaging with a part of the lateral slide portion 60 shown in FIG. 13A. FIG. 14 is a cross-section view along F-F line of FIG. 3.

Figure 9A:
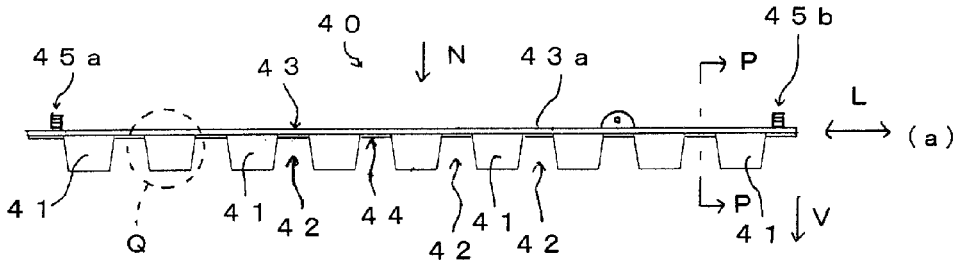
FIG. 9A is a diagram (rear view) showing a securing potion.
Figure 9B:
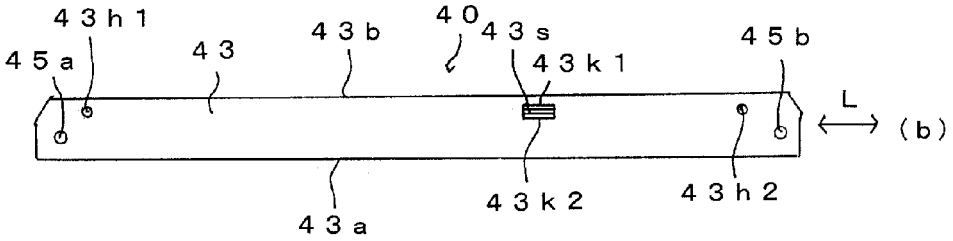
FIG. 9B is a diagram (plan view) showing the securing potion.
Figure 9C:
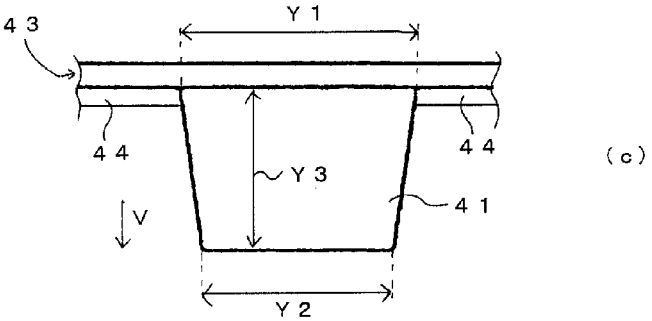
FIG. 9C is a diagram (enlarged view of FIG. 9A) showing the securing potion.
Figure 9D:
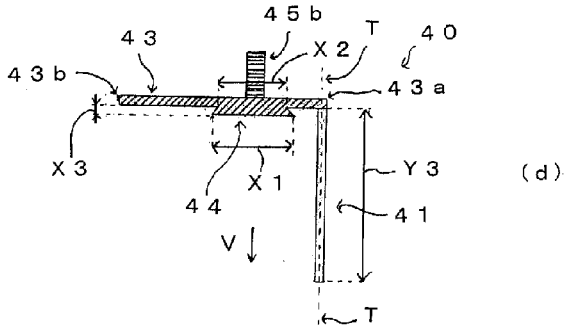
FIG. 9D is a diagram (cross-section view along P-P line of FIG. 9A) showing the securing potion.

FIGS. 9A-9D are diagrams showing the securing portion 40. More specifically, FIG. 9A is a rear view (when viewed from the same direction as viewed in FIG. 2) of the securing portion 40 and FIG. 9B is a plan view (showing a state viewed from the arrow N direction of FIG. 9A) of the securing portion 40. FIG. 9C is an enlarged view of 'Q' part circled with a dotted line in FIG. 9A. FIG. 9D shows a cross-section view along P-P line of FIG. 9A. Explanation will be made with respect to the securing portion 40 with reference to FIGS. 9A-9D.

The securing portion 40 generally comprises: a securing portion base plate 43 of a reed shape having both main surfaces of a rectangle shape (specifically, it is approximately sexanglular by cutting off both side portions of the long side 43*b* in an approximately rectangular triangle shape having one angle of a corner (approximately right angle) formed on the ends of the long side 43*b*) with a pair of long sides 43*a*, 43*b* in approximately parallel along the longitudinal direction L (shown by the arrow L in FIGS. 9A and 9B); securing portion fixing bolts 45*a*, 45*b* (male threads are threaded on an outer face of any one of them) having base ends fixed by welding to one main surface (upper surface) so as to stick out in a vertical direction (up direction) with respect to the one main surface of the securing portion base plate 43; a plurality of tongues 41 fixed by welding to another main surface with approximately even intervals along the long side 43*a* so as to project in a vertical direction with respect to the other main surface (a main surface located at the opposite position to the one main surface to which the base ends of the securing portion fixing bolts 45*a*, 45*b* are attached) of the securing portion base plate 43; and a ridge 44 formed on the other main surface of the securing portion base plate 43 in approximately parallel to a pair of long sides 43*a*, 43*b*. And the securing portion 40 is made of metal material (for example, aluminum, stainless steel, and so on) in one piece.

The securing portion base plate 43 of the reed shape includes a pair of tapped holes 43*h*1, 43*h*2 (tapped holes 43*h*1, 43*h*2 have female threads threaded on inner surfaces) as well as a slit 43*s* as an opening formed in a rectangle shape along the longitudinal direction L and lever support plates 43*k*1, 43*k*2 (any one of them are formed with plate members in an approximately semicircular shape and fixed in approximately parallel with each other such that a predetermined gap is formed therebetween) fixed to a pair of edges opposing to each other along the longitudinal direction L of the slit 43*s*.

The plurality of tongues 41 are all in the same shape and size. More specifically, as shown in FIG. 9C, each tongue 41 is made of a plate member having both main surfaces shaped in an isosceles trapezoid (an isosceles trapezoid having a pair of legs which are not parallel) having a side of length Y1 and a side of length Y2 (here, Y2<Y1) and height Y3. And every tongue 41 has a portion of the side of length Y1 fixed along the long side 43*a* (the main surface of any one of tongues 41 is approximately perpendicular to the other main surface of the securing portion base plate 43) and each of the tongues 41 is fixed along the long side 43*a* with an approximately even interval.

The ridge 44 is formed in approximately parallel with the longitudinal direction L (a ridge 44 is also formed in approximately parallel with a pair of long sides 43*a*, 43*b* are formed), and the ridge 44 has a cross-section shape of the same shape and size in any planes perpendicular to the longitudinal direction L. More specifically, as shown in a cross-section view across one plane perpendicular to the longitudinal direction L of FIG. 9D, the ridge 44 has a cross-section shape exhibiting approximately an isosceles trapezoid (isosceles trapezoid having a pair of legs which are not parallel) having a side of length X1 and a side of length X2 (here, X2<X1) and height of X3 in any planes perpendicular to the longitudinal direction L. And a portion of the side of length X2 is fixed to the other surface (lower surface) of the securing portion base plate 43.

More specifically, FIG. 10A is a rear view (when viewed from the same direction as viewed in FIG. 2) of the lateral slide portion 60 and FIG. 10B is a plan view (showing a state viewed from the arrow N direction of FIG. 10A) of the lateral slide portion 60. FIG. 11A is an enlarged view of 'Q' circled with a dotted line in FIG. 10A and FIG. 11B is a diagram (although the main surface of the tongue 61 is hatched for easy understanding, but the hatching does not indicate a cross-section) showing a relationship between a main surface shape of the tongue 61 to be described later and a main surface shape of the tongue 41 described above. And FIG. 12A shows a cross-section view along P-P line of FIG. 10A. Explanation will be made with respect to the lateral slide portion 60 with reference to FIGS. 10A-10B, 11A-11B, and 12 A.

The lateral slide portion 60 generally comprises: a lateral slide base plate 63 of a reed shape having both main surfaces of a rectangle shape (specifically, it is approximately sexanglular by cutting off both side portions of the long side 43*b* in an approximately rectangular triangle shape having one angle of a corner (approximately right angle) formed on the ends of the long side 43*b*) with a pair of long sides 63*a*, 63*b* approximately parallel to the longitudinal direction L (shown by arrow L in FIGS. 10A and 10B); a front wall part 66 of a reed shape having both main surfaces of a rectangle shape with a pair of long sides in approximately parallel with the longitudinal direction L and having one of the long sides fixed by welding to a long side 63*b* of one main surface such that a main surface of the front wall part 66 is perpendicular to the one main surface (upper surface) of the lateral slide base plate 63; a plurality of tongues 61 fixed by welding to the other main surface with approximately even interval along the long side 63*a* such that each of the plurality of tongues 61 protruding in a vertical direction to the other main surface (a main surface opposite to the one main surface. Here, lower surface) of the lateral slide base plate 63; ridges 64*a*, 64*b* (a groove 64 is formed between these ridges 64*a*, 64*b* which are approximately parallel with each other. in particular, refer to FIG. 12A) formed on the one main surface (upper surface) of the lateral slide base plate 63 in approximately parallel with the pair of long sides 63*a*, 63*b*; a ridge 66*a* formed in approximately parallel with the long side 63*b* on one main surface facing ridges 64*a*, 64*b* among both main surfaces of the front wall member 66; and a lateral slide portion supporting portion 65 formed on one end along the longitudinal direction L of the lateral slide base plate 63. The lateral slide portion 60 is made of metal material (for example, aluminum, stainless steel, and so on). And a rack part 67*f* formed along the longitudinal direction L is arranged on the one main surface (upper surface) of the lateral slide base plate 63 (in particular, refer to FIG. 10B).

All of the plurality of tongues 61 have the same shape and size. More specifically, as shown in FIG. 11A, each of the tongues 61 is formed with a plate member having both main surfaces in an isosceles trapezoid shape (an isosceles trapezoid having a pair of legs which are not parallel) having a side of length Z1 and a side of length Z2 (here, Z2>Z1) and height of Z3 (here, Z3<Y3). And any one of the tongues 61 has the side of length Z1 fixed along the long side 63*a* (the main surface of any one of tongues 61 is approximately perpendicular to the other main surface (lower surface) of the securing portion base plate 63) and respective tongues are fixed along the long side 63*a* with an approximately even interval.

Then, as shown in FIG. 11B in which the main surface of the tongue 61 and the main surface of the tongue 41 are overlapped, the main surface shape of the he tongue 61 and the main surface shape of the tongue 41 are formed as follows. That is, the length Z2 and the length Y2 are made to be approximately the same. If the side of length Z2 and the side of length Y2 are overlapped, both legs of the isosceles trapezoid exhibited by the main surface of the tongue 61 and both legs of the isosceles trapezoid exhibited by the main surface of the tongue 41 overlapped with each other and the difference between Y3 and Z3 is approximately the same as the width of the lateral slide base plate 63. In other words, a portion within the range of distance Z3 from the side of length Y2 of the main surface of the tongue 41 is approximately in the same shape as the main surface shape of the tongue 61. And the gaps between the tongues 61 are corresponding to respective gaps between the tongues 41.

With respect to the groove 64 formed between the approximately parallel ridges 64*a*, 64*b*, the cross-section shape of the groove 64 in any plane perpendicular to the longitudinal direction L has the same shape and size. The cross-section shape exhibits an isosceles trapezoid that is a little larger similarity shape of the above-mentioned isosceles trapezoid exhibited by the ridge 44. Her, a side of Z6 of the isosceles trapezoid that is a cross-section shape in a perpendicular plane to the longitudinal direction of L of the groove 64 (see FIG. 12A) is shorter than length of X1. Therefore, when the ridge 44 is inserted into the groove 64 as shown in FIG. 12B, it is prohibited to remove the lateral slide portion 60 in the perpendicular direction to the longitudinal direction L. And, as shown in FIG. 12B, the ridge 44 of the securing portion 40 can be inserted into the groove 64 of the lateral slide portion 60 in the longitudinal direction L (the ridge 44 can be inserted in a freely slidable manner into the groove 64 in the longitudinal direction L as shown in FIG. 12B by sliding the ridge 44 along the longitudinal direction L from one end in which lateral slide portion supporting portion 65 is not provided among both ends in the longitudinal direction L of the groove 64 to the other end). When the ridge 44 is inserted into the groove 64 as shown in FIG. 12B, the ridge 44 may be freely slid in the longitudinal direction L with respect to the groove 64. However, it is regulated (almost prohibited) to move the ridge 44 in the perpendicular direction to the longitudinal direction L with respect to the groove 64.

And, as shown in FIG. 12B, a rubber gasket 51 (a thin bar-like rubber gasket having a cross-section of approximately rectangle shape along the longitudinal direction L) is inserted between the securing portion base place 43 and the lateral slide base plate 63 along the long side 43*a* and the long side 63*a*. It is prevented or reduced in the degree by the gasket 51 that the mortar (not shown) enters a gap between the securing portion base plate 43 and the lateral slide base plate 63 from the side of the tongue 41 or the tongue 61.

Further, when the ridge 44 is inserted into the groove 64, since the edge portion along the long side 43*b* of the one main surface (the main surface (upper surface) to which base ends of securing portion fixing bolts 45*a*, 45*b* are attached) of the securing portion base plate 43 engages with the ridge 66*a*, the lateral slide portion 60 can slide along the longitudinal direction L with respect to the securing portion 40 (securing portion base plate 43) and it is prohibited to mover the lateral slide portion 60 in the perpendicular direction to the longitudinal direction L with respect to the securing portion 40.

In this way, when the ridge 44 of the securing portion 40 is inserted into the groove 64 of the lateral slide portion 60 as shown in FIG. 12B, the lateral slide portion 60 can freely slide along the longitudinal direction L with respect to the securing portion 40, but it is prohibited to remove the lateral slide portion 60 in a perpendicular direction to the longitudinal direction L with respect to the securing portion 40. When the lateral slide portion 60 is slid to a predetermined position with respect to the securing portion 40 in this way, the main surface of the tongue 61 and the main surface of the tongue 41 just overlap completely (the main surfaces of all tongues 61 and the main surfaces of all tongues 41 just overlap completely). Therefore, a gap 42 formed between the tongues 41 is not covered with the tongue 61 when the main surface of the tongue 61 and the main surface of the tongue 41 just overlap completely at a relative sliding position (hereinafter, referred to as "completely overlapping position") along the longitudinal direction L of the lateral slide portion 60 with respect to the securing portion 40. On the other hand, when the lateral slide portion 60 is slid from the completely overlapping position with respect to the securing portion 40 along the longitudinal direction L, the gap 42 formed between the tongues 41 are covered by the tongues 61 along the longitudinal direction L. The covering ratio of the gap 42 between the tongues 41 varies depending on the sliding amount of the lateral slide portion 60 from the completely overlapping position along the longitudinal direction L with respect to the securing portion 40. In this way, the amount that the gap 42 formed between the tongues 41 is covered by the tongues 61 along the longitudinal direction L can be freely changed by the sliding amount of the lateral slide portion 60 along the longitudinal direction L with respect to the securing portion 40. Therefore, a slit 49 may be formed, a width of which can be freely changed along the longitudinal direction L by the tongues 61 and tongues 41.

When the securing portion fixing bolts 45*a*, 45*b* are inserted into the through hole 23*h* formed in the main body 21 (main body lower portion 23), securing portion fixing nuts 47*a*, 47*b* are engaged with the securing portion fixing bolts 45*a*, 45*b* (near the top end) such that the securing portion 40 is fixed to the main body 21 (main body lower portion 23).

While the securing portion 40 is fixed to the main body 21 (main body lower portion 23), as shown in FIG. 12B, the state that the ridge 44 is inserted slidably into the groove 64 is shown in FIGS. 1 to 8. And, in order to prevent the ridge 44 from dropping off unexpectedly by sliding in the groove 64 unexpectedly along the longitudinal direction L with respect to the securing portion 40, a lateral slide portion supporting portion 65 is fixed to one end along the longitudinal direction L of the lateral slide base plate 63 of the lateral slide portion. The lateral slide portion supporting portion 65 comprises: a plate-like rising portion 65*a* fixed to an edge portion such that the rising portion rises upward from the edge portion of the end along the longitudinal direction L of the lateral slide base plate 63; a hinge portion 65*b* fixed to the rising portion 65*a* in a vicinity of a top end thereof; and a tongue part 65*c* fixed rotatably with the hinge portion 65*b* to the rising portion 65*a*. The tongue part 65*c* has an elongated hole 65*ch* (in particular, refer to FIGS. 3, 10B, 13A, and 14) formed as a longitudinal direction of the hole is along the longitudinal direction L. A securing portion fixing bolt 45*a* is inserted into the elongated hole 65*ch* and a securing portion fixing nut 47*a* is engaged with the securing portion fixing bolt 45*a* sticking out upward.

Also, a tongue part receiving groove 24 which receives slidably the tongue part 65*c* along the longitudinal direction L is formed in the main body 21 (main body lower portion 23) such that the tongue part 65*c* can slide within a predetermined range along the longitudinal direction L in a condition that the tongue part 65*c* is inserted into the tongue part receiving groove 24. Here, the securing portion fixing bolt 45*b* is also inserted into the through hole 23*h* formed in the main body 21 (main body lower portion 23). A securing portion fixing nut 47*b* is engaged with the securing portion fixing bolt 45*b* (in the vicinity of the top end) and the securing portion fixing nut 47*b* is directly contact the top surface of the main body 21 (main body lower portion 23).

As described above, the lateral slide portion 60 can slide along the longitudinal direction L for the play of the elongated hole 65*ch* with respect to the securing portion fixing bolt 45*a* of the securing portion 40 along the longitudinal direction L.

In addition, female threads of a pair of tapped holes 43*h*1, 43*h*2 formed in the securing portion base plate 43 engage with a pair of lateral slide portion securing screw 68*a*, 68*b* (male threads). The pair of lateral slide portion securing screw 68*a*, 68*b* both are inserted into the tapped holes 43*h*1, 43*h*2 toward an approximately vertical direction to the lateral slide base plate 63 (upper surface) of the lateral slide portion 60. Tip ends of axis portions of the lateral slide portion securing screw 68*a*, 68*b* can proceed or retreat with respect to the lateral slide base plate 63 (upper surface) of the lateral slide portion 60 by turning the lateral slide portion securing screw 68*a*, 68*b* in a normal direction or a reverse direction with respect to the securing portion base plate 43. It is prohibited that the lateral slide portion 60 slides along the longitudinal direction L with respect to the securing portion 40 by making the tip ends of the axis portions of the lateral slide portion securing screws 68*a*, 68*b* contact the lateral slide base plate 63 (upper surface). In addition, the lateral slide portion 60 is allowed to slide along the longitudinal direction L with respect to the securing portion 40 by separating the tip ends of the axis portions of the lateral slide portion securing screws 68*a*, 68*b* from the lateral slide base plate 63 (upper surface).

And, a lateral slide portion slide lever 69 is supported rotatably around a lever support bar 43*q* by the lever support bar 43*q* (see FIG. 7) arranged in an approximately vertical direction to the lever support plate 43*k*1, 43*k*2 arranged on both sides of the slit 43*s* formed in the securing portion base plate 43. The lateral slide portion slide lever 69 comprises: a bar main body 69*a* supported rotatably on a base end side by a lever support bar 43*q*; and a pinion portion 69*c* disposed on the base end side of the bar main body 69*a* along a semicircle about the lever support bar 43*q*. Thus, the lateral slide portion slide lever 69 can be turned around the lever support bar 43*q* by grasping the bar main body 69*a*. The pinion portion 69*c* engages with a rack portion 67*f* formed in the lateral slide base plate 63. In this way, the lateral slide portion slide lever 69 is turned around the lever support bar 43*q* such that force can be applied to any one of the securing portion 40 (securing portion base plate 43) and the lateral slide portion 60 along the longitudinal direction L. Therefore, the lateral slide portion 60 can be slid either direction along the longitudinal direction L with respect to the securing portion 40 (securing portion base plate 43).

The unintended slide of the lateral slide portion 60 is prohibited with respect to the securing portion 40 by making the tip ends of the axis portions of the lateral slide portion fixing screws 68*a*, 68*b* contact the lateral slide base plate 63 (upper surface). In addition, the lateral slide portion 60 is slid to a desired slide position with respect to the securing portion 40 by turning the lateral slide portion slide lever 69 in a state that the tip ends of the axis portions of the lateral slide portion fixing screws 68*a*, 68*b* are apart from the lateral slide base plate 63 (upper surface) and the slide of the lateral slide portion 60 with respect to the securing portion 40 is prohibited by making the tip ends of the axis portions of the lateral slide portion fixing screws 68*a*, 68*b* contact the lateral slide base plate 63 (upper surface). In this way, the desired slide position is retained.

Vertical slide edge slide rails 86*a*, 86*b*, 86*c* are arranged along an up-and-down direction on the rear side (the surface 22*b* in which the tongue 61 and the tongue 41 exist among both surfaces 22*a*, 22*b* of the plate-like shape formed by the main body 21) of the main body 21. Any of the vertical slide edge slide rails 86*a*, 86*b*, 86*c* are provided with notches in every longitudinal direction (here, up-and-down direction). Slide members 88*a*, 88*b*, 88*c* (as shown in FIG. 8, a notch engaging spring 87 is arranged in the slide member such that it is latched at every interval between notches like a ticking clock) which are moveable in the longitudinal direction of vertical slide edge slide rails 86*a*, 86*b*, 86*c* are inserted into the vertical slide edge slide rails 86*a*, 86*b*, 86*c* as the notches provided to them are engaging. The vertical slide edge slide lever 85*a* is attached to the vicinity of the top end of the slide member 88*a* to engage with the vertical slide edge slide rail 86*a*. And the vertical slide edge slide lever 85*c* is attached to the vicinity of the top end of the slide member 88*c* to engage with the vertical slide edge slide rail 86*c*. Respective vertical slide edge vertical slide edge securing screw 83*a*, 83*b*, 83*c* are attached to the vicinity of the bottom end of the slide member 88*a*, 88*b*, 88*c* to engage with the vertical slide edge slide rail 86*a*, 86*b*, 86*c*.

On the other hand, a vertical slide edge sliding plate 89 is attached to a rear surface 22*b* of the main body 21. The vertical slide edge sliding plate 89 is formed with a plate member having a main surface 89*a* over a flat plane. The main surface 89*a* is formed in a flat manner and made of material (e.g., hard synthetic resin) having a small friction coefficient with a rear surface (metal) of the vertical slide edge 81 such that the main surface 89*a* may slide smoothly with the rear surface of the vertical slide edge 81 (made of metal) (here, part of the vertical slide edge sliding plate 89 corresponding to the above the vertical slide edge slide rails 86*a*, 86*b*, 86*c* is cut out).

The vertical slide edge 81 is arranged such that the main surface 89*a* of the vertical slide edge sliding plate 89 contact the rear surface. The vertical slide edge 81 is made of a thin plate member of a reed shape (belt-like) having a top edge 82*a* and a bottom edge 82*b*, which are in approximately parallel, and is supported by the vertical slide edge securing screws 83*a*, 83*b*, 83*c* such that the top edge 82*a* and the bottom edge 82*b* are in approximately parallel in the longitudinal direction L in FIGS. 1 to 8. As described above, respective slide members 88*a*, 88*b*, 88*c* to which the vertical slide edge securing screws 83*a*, 83*b*, 83*c* are attached to the vicinity of the bottom end thereof can move freely along the vertical slide edge slide rails 86*a*, 86*b*, 86*c*. And the vertical slide edge securing screws 83*a*, 83*b*, 83*c* allows the vertical slide edge 81 to turn around itself to some degree such that the slide members 88*a*, 88*b*, 88*c* are moved along the vertical slide edge rails 86*a*, 86*b*, 86*c*, respectively. In this way, not only height of the vertical slide edge 81 with respect to the main body 21, but also the inclination to the longitudinal direction L of the top edge 82*a* and the bottom edge 82*b* can be adjusted. Here, as shown in FIG. 8, a rubber gasket 53 (a disk shape with a hole at the center) is fitted around the vertical slide edge securing screw 83*a* on the main body 21 side of the vertical slide edge 81 through which the vertical slide edge securing screw 83*a* provided to the vicinity of the bottom end of the slide member 88*a* penetrates. The gasket 53 prevents or reduce the degree of ingress of mortar (not shown) toward the vertical slide edge slide rail 86*a* side through a gap between the tongue 41 and the vertical slide edge 81.

A height adjusting part 91 comprises a pair of height adjusting parts 91*a*, 91*b* arranged on both sides along the longitudinal direction L of the main body 21. The pair of height adjusting parts 91*a*, 91*b* have a similar configuration. More specifically, each of the pair of height adjusting parts 91*a*, 91*b* comprises: a female threaded portion 93 of a sleeve-like shape, an interior of which is threaded with female threads, the female threaded portion 93 attached to the main body 21; a male threaded portion 92 which the female threads of the female threaded portion 93 engages with and which is inserted into the female threaded portion 93; and a closing valve part 94 to prevent ingress of mortar (not shown) into the inside of the female threaded portion 93 from the bottom end, the closing valve part 94 being attached to the bottom end of the female threaded portion 93.

The female threaded portion 93 is configured with a hollow cylinder shape with an open top end and an open bottom end and the interior of the hollow cylinder is threaded with female threads in an up-and-down direction. Here, with any one of the height adjusting parts 91*a*, 91*b*, a top end of the female threaded portion 93 is attached to each of the height adjusting part support portions 29*a*, 29*b* formed in the main body 21 (main body lower portion 23) such that the female threaded portion 93 is supported by the main body 21 (main body lower portion 23). The male threaded portion 92 comprises an axis portion, an exterior of which is threaded with male threads to engage with the female threads of the female threaded portion 93; and a grasping portion (a portion which is grasped by fingers when the male threaded portion 92 is turned) formed with plate member having both main surfaces of an approximately ellipse shape. The axis portion is inserted into the female threaded portion 93 and the male threaded portion 92 is turned in a normal direction or in a reverse direction by grasping the grasping portion such that the male threaded portion 92 can be freely moved forward or backward in the up-and-down direction with respect to the female threaded portion 93. Here, the turning of the male threaded portion 92 is made manually, but it can be made by the electric power (driving by motor).

The closing valve part 94 allows the axis portion of the male threaded portion 92 to move in any of the upward direction and the downward direction as the axis portion is penetrating and the closing valve part 94 closes the bottom end of the female threaded portion 93 when the bottom end of the axis portion of the male threaded portion 92 is at an upper position from the bottom end of the female threaded portion 93. The closing valve part 94 prevents ingress of mortar (not shown) into the inside of the female threaded portion 93 from the bottom end of the female threaded portion 93 such that clogging with mortar (not shown) inside the female threaded portion 93 is prevented.

As mentioned above, this type of height adjusting parts 91*a*, 91*b* can allow the bottom end of the male threaded portion 92 to be freely moved in an upward or downward direction with respect to the main body 21. Therefore, respective bottom ends of the male threaded portions 92 of the height adjusting parts 91*a*, 91*b* can be adjusted in an upward direction or a downward direction with respect to the main body while the bottom end of the male threaded portion 92 is in contact with the surface of the concrete slab (not shown). Thus, not only the height of the main body 21 with respect to the surface of the concrete slab (not shown), but also the inclination with respect to the surface of the concrete slab (not shown) in the longitudinal direction can be adjusted.

The stand 96 comprises: a base member 96*a*, a base end of which is attached rotatably (an approximately parallel rotational axis along the longitudinal direction) to the main body 21; and an end member 96*b* attached rotatably (an approximately parallel rotational axis along the longitudinal direction) to the end portion of the base member 96*a*. The end portion of the end member 96*b* and another portion (for example, a tip end of the tongue 61 and/or the tongue 41, a bottom end of axis portion of the male threaded portion 92 of the height adjusting parts 91*a*, 91*b*) of the present apparatus 11 are in contact with the placing surface (for example, a surface of the concrete slab (not shown) or the like) of the present apparatus 11 such that the present apparatus 11 may stand by itself on the placing surface (for example, a surface of the concrete slab (not shown) or the like). Here, both turnings: turning of the base end of the base member 96 with respect to main body 21 and turning of the base end of the end member 96*b* with respect to the base member 96*a* require application of force to some degree (resistance exists) such that it is possible to keep the present apparatus 11 standing with the desired angle on the placing surface.

In addition, the stand 96 has the base end configured to be attachable to and detachable from the main body 21 such that it can be detached when it is not necessary and it can be attached thereto when it is necessary.

Figure 15:
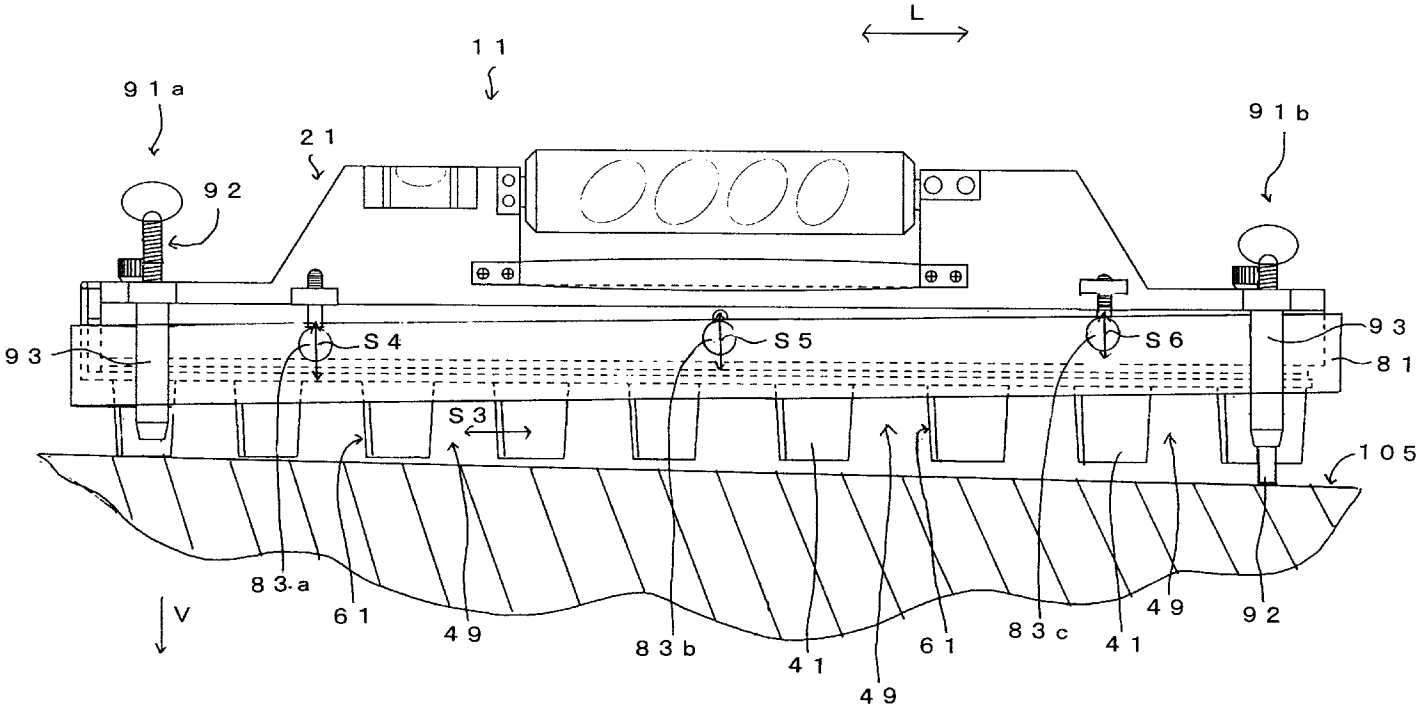
FIG. 15 is a diagram showing a status of a present apparatus mounted on a placing surface (cross-section view).

A state that such present apparatus 11 is placed on the placing surface 105 (plane) is shown in FIG. 15 (the present apparatus 11 is viewed from the rear side in the same way as in FIG. 2). As shown in FIG. 15, with respect to the present apparatus 11, the inclination of the present apparatus 11 with respect to the placing surface 105 can be varied according to the following adjustments.

(Adjustment 1) The width of the slit 49 formed between the tongue 61 and the tongue 61 is changed by S3 moving the lateral slide portion 60 along the longitudinal direction L with respect to the securing portion 40;

(Adjustment 2) The height of the vertical slide edge 81 from the placing surface 105 is adjusted by S4, S5, S6 moving the position of the vertical slide edge securing screws 83*a*, 83*b*, 83*c* supporting the vertical slide edge 81 with respect to the main body 21;

(Adjustment 3) The inclination of the vertical slide edge 81 with respect to the placing surface 105 is changed by S4, S5, S6 shifting the positions of the vertical slide edge securing screws 83*a*, 83*b*, 83*c* with respect to the main body 21;

(Adjustment 4) The height of the height adjusting part 91*a* from the placing surface 105 is adjusted by moving forward or backward the male threaded portion 92 of the height adjusting part 91*a* with respect to the female threaded portion 93;

(Adjustment 5) The height of the height adjusting part 91*b* from the placing surface 105 is adjusted by moving forward or backward the male threaded portion 92 of the height adjusting part 91*b* with respect to the female threaded portion 93; and (Adjustment 6) The height of the height adjusting part 91*a* and the height adjusting part 91*b* from the placing surface 105 are adjusted as described in (Adjustment 4) and (Adjustment 5).

Figure 16:
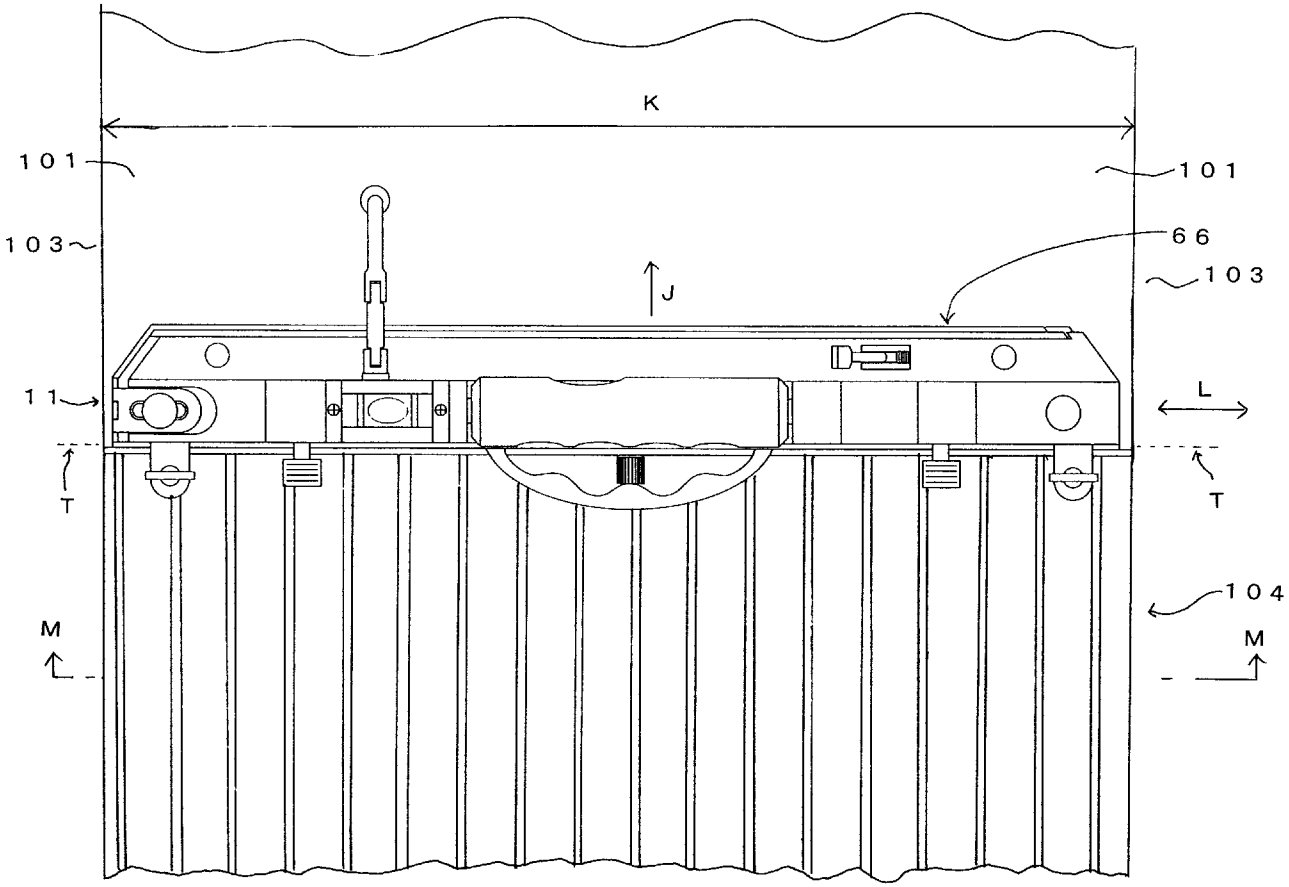
FIG. 16 is a plan view showing a status that a ridge-and-groove shape is formed by utilizing a present apparatus with adhesive mortar applied onto a surface of an attaching slab (concrete slab).
Figure 17:
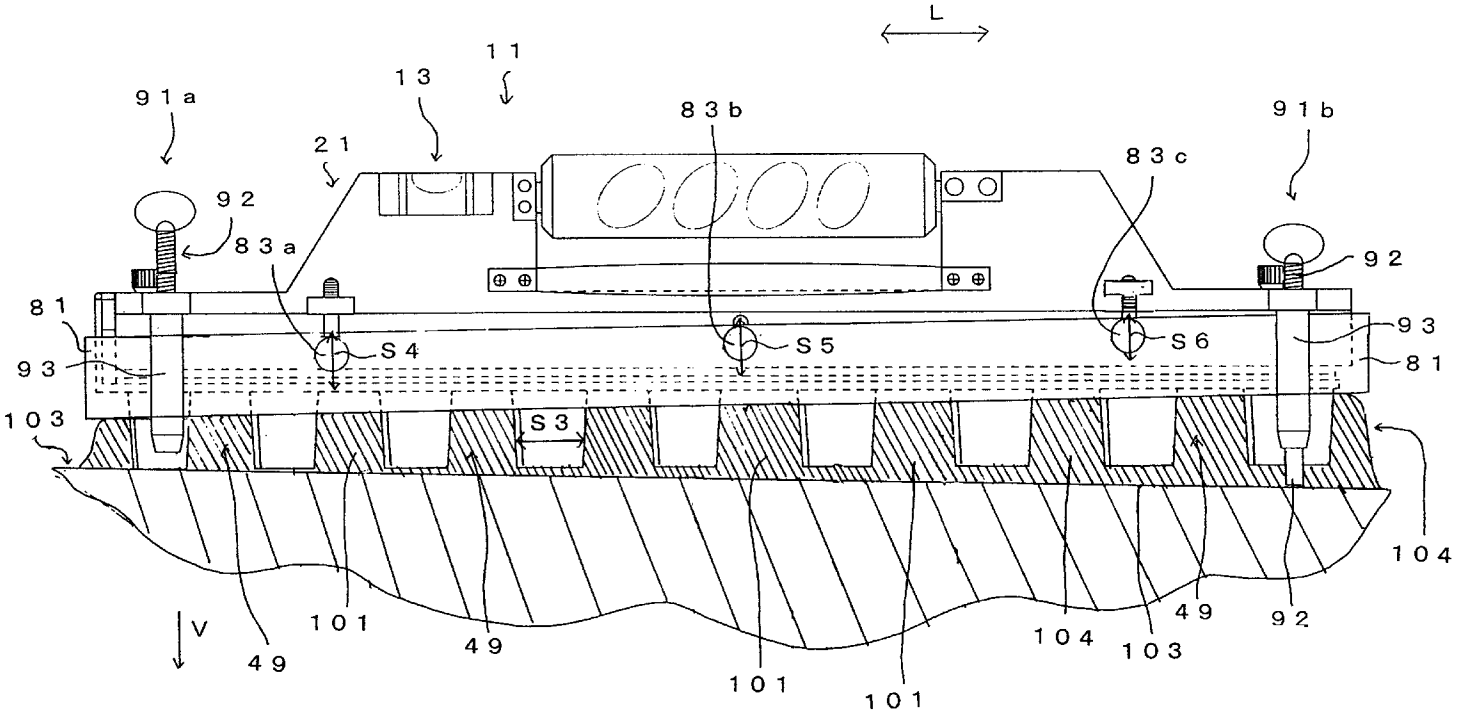
FIG. 17 is a cross-section view along M-M line of FIG. 16.

FIG. 16 is a plan view showing how a ridge-and-groove shape is formed by the present apparatus with adhesive mortar 101 (to adhere the tile and the subject slab 103) applied with a predetermined thickness to the surface of the subject slab (concrete slab) 103 on which tiles (not shown) are bonded. FIG. 17 is a cross-section view along M-M line of FIG. 16. The forming method of forming the ridge-and-groove shape of the adhesive mortar 101 will be explained with reference to FIGS. 16 and 17.

First, adhesive mortar 101 is applied to the surface of the subject slab 103 with a predetermined thickness (for example, 10 mm) and a predetermined width K (refer to FIG. 16). The predetermined width K is a little shorter than the width of the subject tile (not shown) to be bonded later (for example, 10 to 20 mm shorter than the tile width).

Next, the present apparatus 11 (what has the size along the longitudinal direction L being approximately the same as the width K is used) having been adjusted with respect to contents of the above (Adjustment 1) to (Adjustment 6) is moved in the arrow J direction (with the predetermined width K and a vertical direction) (the user (not shown) of the present apparatus 11 grasps the grasping portion 15 with the hand and moves the present apparatus 11 in the arrow J direction by applying force toward the arrow J direction to the present apparatus 11). In this way, the adhesive mortar 101 passes through the slits 49 of the present apparatus 11 such that the ridge-and-groove shape 104 corresponding to the shape of slits 49 can be formed with the adhesive mortar 101. Here, during the operation of forming a floor structure by forming the adhesive mortar 101 in the ridge-and-groove shape 104 with the present apparatus 11 and laying tiles (not shown), the present apparatus 11 can be retained (in this way, it is possible to prevent the adhesive substance from adhering to the present apparatus more effectively than the case where the present apparatus 11 is laid around on the surface of the subject slab (it is likely that the adhesive mortar 101 exists)) as the present apparatus 11 is standing by itself on the surface of the subject slab 103 with the stand 96 when the present apparatus 11 is not used. It is not necessary to say that the stand 96 can be detached as appropriate depending on the operation.

Here, when the ridge-and-groove shape 104 is formed with the adhesive mortar 101 by moving the present apparatus 11 in the arrow J direction, the front wall member 66 can prevent or reduce the degree of adhesion of the adhesive mortar 101 to the main body 21.

Figure 20A:
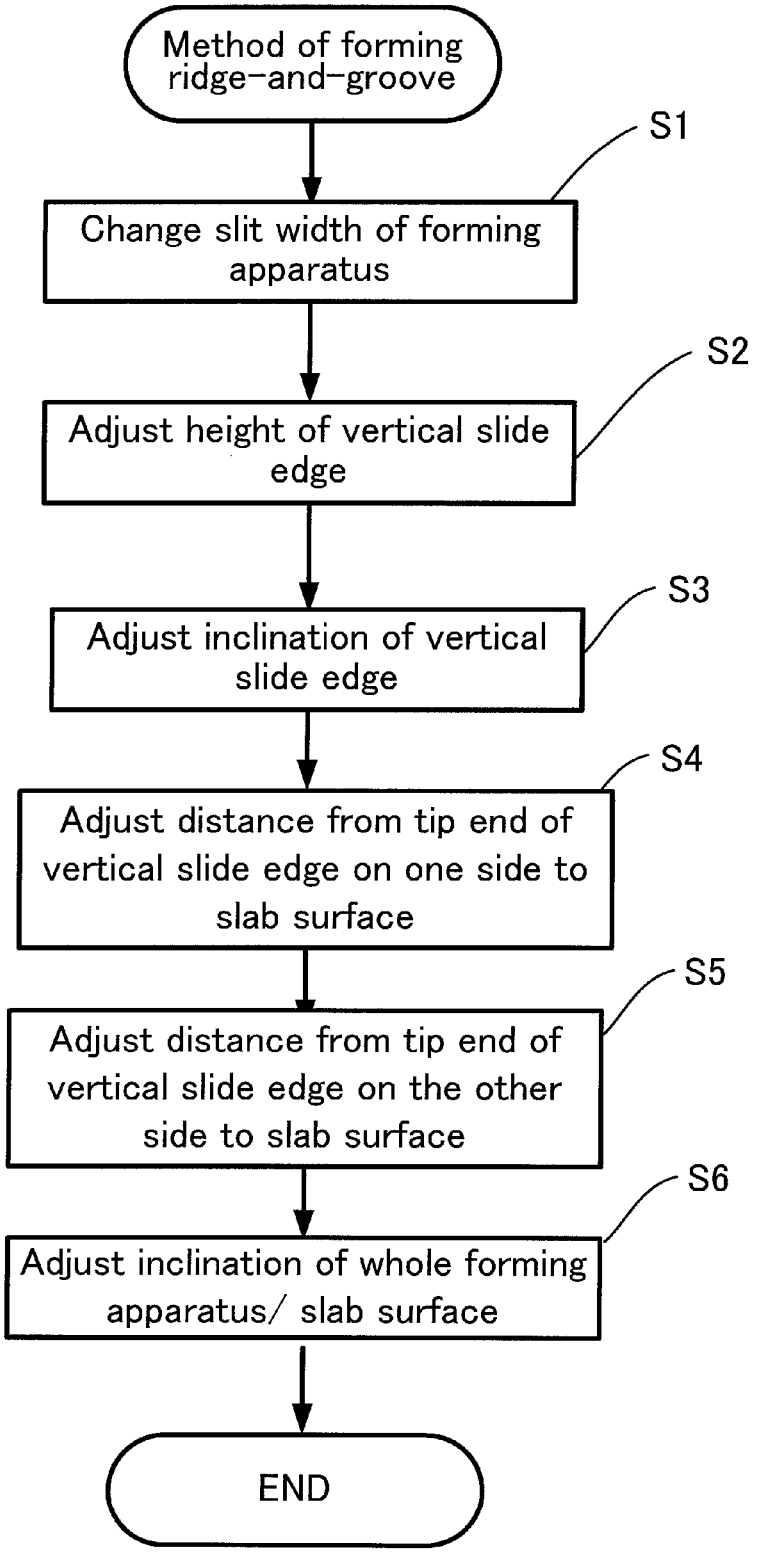
FIG. 20A is a flow chart of an example of a method of forming adhesive mortar in a ridge-and-groove shape with the present apparatus.
Figure 20B:
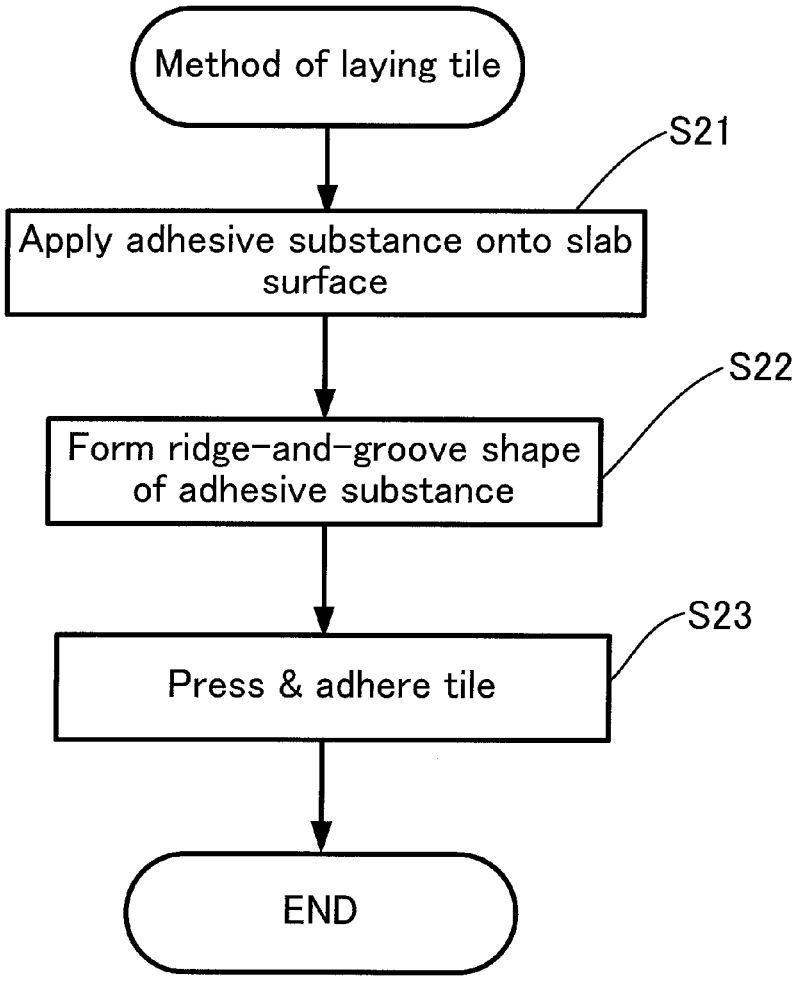
FIG. 20B is a flow chart of an example of a method of adhering a tile on a surface of a slab with the present apparatus.

The above (Adjustment 1) to (Adjustment 6) will be explained in detail as follows (refer to FIG. 20A). As shown in FIG. 17, with respect to the ridge-and-groove shape 104 to be formed with the adhesive mortar 101, the following may be conducted freely. (Adjustment 1, S1 (FIG. 20A)) Each width of each ridge formed with the adhesive mortar 101 is changed by changing each width of each slit 49 by moving the lateral slide portion 60 along the longitudinal direction L with respect to the securing portion 40; (Adjustment 2, S2 (FIG. 20A)) The height from the ridge portion (upper surface) of the ridge-and-groove shape to the valley is changed by S4, S5, S6 moving the position of the vertical slide edge securing screws 83*a*, 83*b*, 83*c* supporting the vertical slide edge 81 with respect to the main body 21;

(Adjustment 3, S3 (FIG. 20A)) The inclination of the ridge portion (upper surface) of the ridge-and-groove shape with respect to the width direction is changed by changing the inclination of the vertical slide edge 81 with respect to the placing surface 105 by S4, S5, S6 shifting the positions of the vertical slide edge securing screws 83*a*, 83*b*, 83*c* with respect to the main body 21;

(Adjustment 4, S4 (FIG. 20A)) The thickness of the adhesive mortar 101 from the valley portion of the ridge-and-groove shape to the surface of the subject slab 103 on the height adjusting part 91*a* side is changed by adjusting the height of the height adjusting part 91*a* from the surface of the subject slab 103 by moving forward or backward the male threaded portion 92 of the height adjusting part 91*a* with respect to the female threaded portion 93;

(Adjustment 5, S5 (FIG. 20A)) The thickness of the adhesive mortar 101 from the valley portion of the ridge-and-groove shape to the surface of the subject slab 103 on the height adjusting part 91*a* side is changed by moving forward or backward the male threaded portion 92 of the height adjusting part 91*b* with respect to the female threaded portion 93; and (Adjustment 6, S6 (FIG. 20A)) The thickness of the adhesive mortar 101 from the valley portion of the ridge-and-groove shape to the surface of the subject slab 103 with respect to the width direction (longitudinal direction L) is changed by changing the inclination of the present apparatus 11 with respect to the surface of the subject slab 103 by adjusting the heights of the height adjusting part 91*a* and the height adjusting part 91*b* from the surface of the subject slab 103 in such a way according to (Adjustment 4) and (Adjustment 5). Here, these adjustments 1 to 6 can be performed while the present apparatus 11 is checked with the bubble tube level 13 if it is horizontal (in the longitudinal direction L). FIG. 20B shows a flowchart illustrating a method of bonding a tile 106 over the subject slab 103 in accordance with the method of forming the ridge-and-groove shape 104 with the mortar 101. That is, the adhesive substance is first applied to the slab surface as the subject member in the method of laying tiles (S21). Next, as illustrated above with FIG. 20A and the like, the surface structure of the adhesive substance is modified. That is, the ridge-and-groove shape is formed on the surface (S22). And the tile is laid and pressed over it such that the tile is bonded (S23).

Figure 18A:
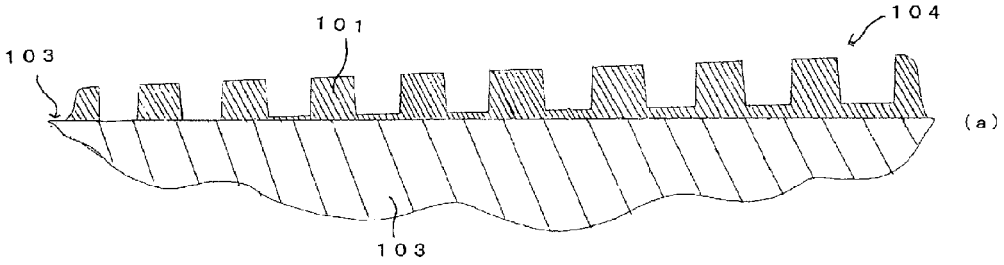
FIG. 18A is an end view (M-M end face of FIG. 16 (state of FIG. 17)) illustrating an example of a ridge-and-groove shape of the adhesive mortar formed with a present apparatus.

FIGS. 18A-18 C and 19A-19C show end views (showing the M-M end view of FIG. 16) illustrating examples of the ridge-and-groove shape formed with the adhesive mortar 101 by the present apparatus 11.

FIG. 18A shows the ridge-and-groove shape 104 of the adhesive mortar 101 formed by the present apparatus 11 in condition shown in FIG. 17.

Figure 18B:
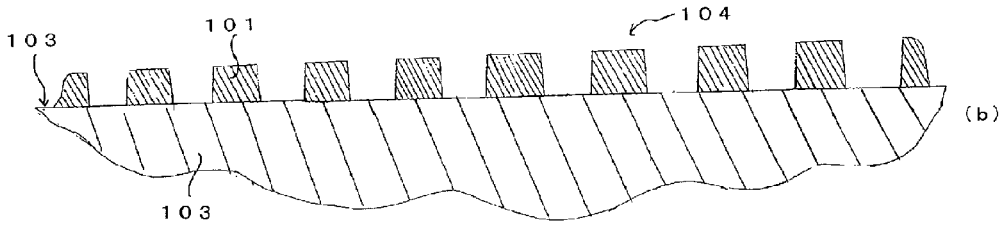
FIG. 18B is an end view (M-M end face of FIG. 16 (Adjustments 5, 6)) illustrating an example of a ridge-and-groove shape of the adhesive mortar formed with the present apparatus.

FIG. 18B shows the ridge-and-groove shape 104 of the adhesive mortar 101 in a state that the thickness of the adhesive mortar 101 from the valley portion of the ridge-and-groove shape to the subject slab 103 on the height adjusting part 91*b* side is reduced (set to approximately 0 mm in the same way as with the height adjusting part 91*a* side) by moving up the male threaded portion 92 of the height adjusting part 91*b* of the present apparatus with respect to the female threaded portion 93 from the state as shown in FIG. 18A (Adjustments 5 and 6).

Figure 18C:
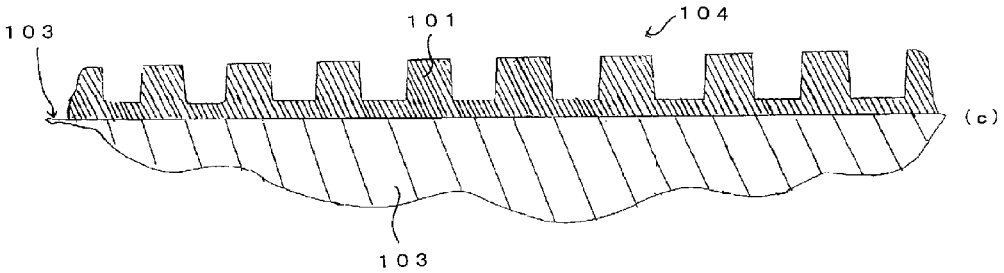
FIG. 18C is an end view (M-M end face of FIG. 16 (Adjustments 4, 6)) illustrating an example of a ridge-and-groove shape of the adhesive mortar formed with the present apparatus.

FIG. 18C shows the ridge-and-groove shape 104 of the adhesive mortar 101 in a state that the thickness of the adhesive mortar 101 from the valley portion of the ridge-and-groove shape to the subject slab 103 on the height adjusting part 91*a* side is increased (set approximately the same as the height adjusting part 91*b* side) by moving down the male threaded portion 92 of the height adjusting part 91*a* of the present apparatus with respect to the female threaded portion 93 from the state as shown in FIG. 18A (Adjustments 4 and 6).

Figure 19A:
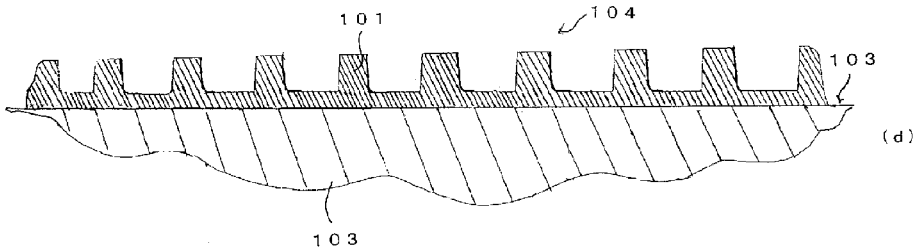
FIG. 19A is an end view (M-M end face of FIG. 16 (Adjustment 1)) illustrating an example of a ridge-and-groove shape of the adhesive mortar formed with the present apparatus.

FIG. 19A shows the ridge-and-groove shape 104 in which the width of the ridge portion formed with the adhesive mortar 101 is reduced by reducing the width of the slit 49 by S3 moving the lateral slide portion 60 along the longitudinal direction L with respect to the securing portion 40 in the present apparatus 11 from a state as shown in FIG. 18C.

Figure 19B:
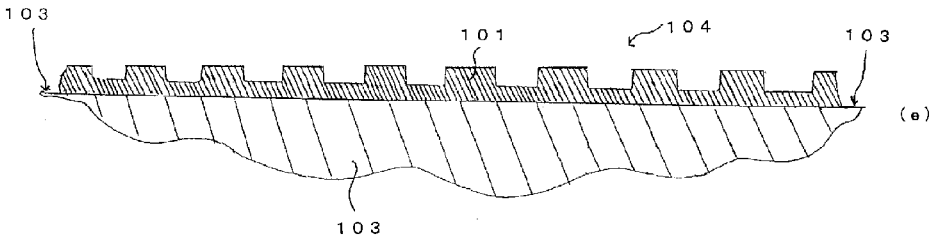
FIG. 19B is an end view (M-M end face of FIG. 16 (Adjustment 2)) illustrating an example of a ridge-and-groove shape of the adhesive mortar formed with the present apparatus.

FIG. 19B shows the ridge-and-groove shape 104 in which the height from the ridge portion (upper surface) of the ridge-and-groove shape to the valley portion is reduced by S4, S5, S6 moving (here, dropping) the positions of the vertical slide edge securing screws 83*a*, 83*b*, 83*c* supporting the vertical slide edge 81 with respect to the main body 21 in the present apparatus 11 from a state as shown in FIG. 18C (Adjustment 2).

Figure 19C:
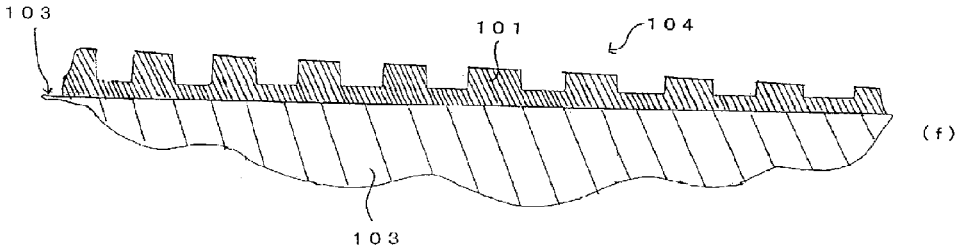
FIG. 19C is an end view (M-M end face of FIG. 16 (Adjustment 3)) illustrating an example of a ridge-and-groove shape of the adhesive mortar formed with the present apparatus.
Figure 19D:
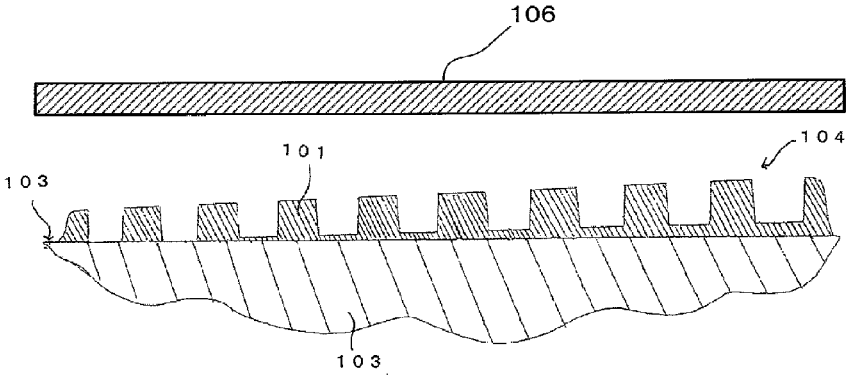
FIG. 19D is a diagram illustrating a relationship between a ridge-and-groove shape and a tile of FIG. 17.

FIG. 19C shows the ridge-and-groove shape 104 in which the inclination of the ridge portion (upper surface) of the ridge-and-groove shape with respect to the width direction (longitudinal direction L) is changed by changing the inclination of the vertical slide edge 81 with respect to the surface of the subject slab 103 by S4, S5, S6 shifting (here, respective movement amounts are different) the positions of the vertical slide edge securing screws 83*a*, 83*b*, 83*c* with respect to the main body 21 in the present apparatus 11 from a state as shown in FIG. 18C (Adjustment 3). FIG. 19D shows the relationship between the ridge-and-groove shape 104 of the adhesive mortar 101 formed by the present apparatus 11 in condition as shown in FIG. 17 and the tile 106 to be pressed and bonded over it.

As described above, the floor structure may be completed by laying tiles (not shown) by laying and pressing the tiles (not shown) over the mortar in the way as conventionally utilized while the ridge-and-groove shape 104 of the adhesive mortar 101 is formed by the present apparatus 11.

As explained above, the present apparatus 11 is a forming apparatus to form the upper surface in a ridge like shape (ridge-and-groove shape 104) of the adhesive substance (here, it is the adhesive mortar 101) to adhere the laying surface (here, it is the surface of the subject slab 103) on which tiles are laid and the tile. The present apparatus 11 comprises: tongue forming means (here, a securing portion 40) including: a plurality of tongues 41 being provided with gaps 42 therebetween and protruding from respective base ends thereof (a side of length Y1 of a tongue 41) existing on a bottom defining line (a line segment along the long side 43*a*) to respective tip ends thereof (a side of length Y2 of a tongue 41) as free ends in each direction of protrusion 'V' (arrow 'V' direction in the figure), which is one of two directions parallel to a tongue existence plane (a dotted line 'T') and perpendicular to the bottom defining line (a line segment along the long side 43*a*, to which a side of length Y1 of the tongue 41 is attached) as a line segment existing in the tongue existence plane of a flat surface (shown by a dotted line T in the figure. a plane in which the tongue 41 exist); and a tongue securing portion (here, a securing portion base plate 43) securing the base ends (a side of length Y1 of a tongue 41) of the plurality of tongues 41 along the bottom defining line (a line segment along the long side 43*a*) by fixing the base ends (a side of length Y1 of a tongue 41) of the plurality of tongues 41 to an edge portion (an edge portion formed by the long side 43*a*) of the tongue securing portion along the bottom defining line (a line segment along the long side 43*a*); grasping means (here, a main body 21) grasped by a user and directly or indirectly fixed to the tongue securing portion (a securing portion base plate 43); and contact means (a tongue 41 and height adjusting parts 91*a*, 91*b*) directly or indirectly fixed to the tongue forming means (a securing portion 40) and having at least two contact points (here, they are a tip end of the tongue 41 (part of side of length Y2 of the tongue 41) and bottom ends of male threaded portions 92 of the height adjusting parts 91*a*, 91*b*) contacting at least two points on a virtual plane of a flat surface perpendicular to the direction of protrusion 'V', legs of perpendicular lines standing on the tongue existence plane (a dotted line 'T') from the at least two contact points (here, they are a tip end of the tongue 41 (part of side of length Y2 of the tongue 41) and bottom ends of male threaded portions 92 of the height adjusting parts 91*a*, 91*b*) or the at least two contact points themselves (since the tip end of the tongue 41 (part of side of length Y2 of the tongue 41) exist in the tongue existence plane (a dotted line T), it is the tip end of the tongue 41 as at least two contact points while, since the bottom end of the male threaded portion 92 of the height adjusting portion 91*a*, 91*b* does not exist in the tongue existence plane (the dotted line T), they are legs of perpendicular lines to the tongue existence plane (the dotted line T) of the bottom end of the male threaded portion 92 as the legs of the perpendicular lines to the tongue existence plane of the at least two contact points) existing on a contact defining line of a line segment located on a protrusion direction 'V' side from the bottom defining line (a line segment along the long side 43*a*) in the tongue existence plane (for example, with respect to the contact points of the tip end of the tongues 41 (part of side of length Y2 of the tongue 41), the tip end of the tongue 41 (part of side of length Y2 of the tongue 41) exists on a line segment (here, the line segment existing distance Y3 apart from the projection direction V side approximately parallel to a line segment existing on the projection direction V side from the bottom defining line (a line segment along the long side 43*a*) on the tongue existence plane (the dotted line T). Also, legs of perpendicular lines to the tongue existence plane (the dotted line T) of the bottom end of a pair of male threaded portion 92 exist on a line segment existing on the projection direction V side from the bottom defining line (a line segment along the long side 43*a*) on the tongue existence plane (the dotted line T)). Here, at least two points on the virtual plane on which the at least two contact points contact exist on the same positions (a tip end of a tongue 41) as the tip ends (a portion on a side of length Y2 of a tongue 41) of the tongues 41 do or in positions located towards the protrusion direction 'v' (bottom ends of a pair of male threaded portions 92) therefrom.

The present apparatus 11 further comprises: passing gap changing means that changes the orthographic projection onto the tongue existence plane (a dotted line 'T') of the passing gap (it is approximately the same as the hatching portion indicating the adhesive mortar 101 of FIG. 17) which is open toward both directions perpendicular to the tongue existence plane (a dotted line 'T') and exists between the bottom defining line (a line segment along the long side 43*a*) and the contact defining line (for example, it is a line indicating the placing surface 105 as shown in FIG. 1). The passing gap changing means comprises the lateral slide portion 60 (Adjustment 1: slit 49 width change); the vertical slide edge 81 and a mechanism (Adjustment 2: change of the height from the ridge portion (upper surface) of the ridge-and-groove shape to the valley portion; Adjustment 3: change of the inclination of the ridge portion (upper surface) with respect to the width direction. Here, the mechanism to slide the vertical slide edge 81 includes vertical slide edge slide rails 86*a*, 86*b*, 86*c*; vertical slide edge slide levers 85*a*, 85*b*, 85*c*; slide member 88*a*, 88*b*, 88*c*; and vertical slide edge securing screws 83*a*, 83*b*, 83*c*.) sliding the same; and the height adjusting part 91 (Adjustment 4: change of thickness of the adhesive mortar 101 from the valley portion of the ridge-and-groove shape on the height adjusting part 91*a* side to the surface of the adhesive slab; Adjustment 5: change of thickness of the adhesive mortar 101 from the valley portion of the ridge-and-groove shape on the height adjusting part 91*a* side to the surface of the adhesive slab 103; Adjustment 6: the thickness of the adhesive mortar 101 from the valley portion of the ridge-and-groove shape on the height adjusting part 91*a* side to the surface of the adhesive slab 103 is changed in the width direction (longitudinal direction L).).

In the present apparatus 11, the passing gap changing means (the lateral slide portion 60, the vertical slide edge 81 and mechanism sliding the same (the vertical slide edge slide rails 86*a*, 86*b*, 86*c*; the vertical slide edge slide levers 85*a*, 85*b*, 85*c*; the slide member 88*a*, 88*b*, 88*c*; and the vertical slide edge securing screws 83*a*, 83*b*, 83*c* are included), and the height adjusting part 91) is constituted of the contact means (a tongue 41 and height adjusting pars 91*a*, 91*b*) including an additional contact portion (the height adjusting parts 91*a*, 91*b*) which can be in both conditions: a protrusion condition in which legs of the perpendicular lines extending to the tongue existence plane from the at least two contact points or the at least two contact points themselves (here, the bottom end of the male threaded portion 92 of the height adjusting parts 91*a*, 91*b* is the contact point and the bottom end of the male threaded portion 92 of the height adjusting parts 91*a*, 91*b* does not exist in the tongue existence plane (the dotted line T). Thus, it is a leg of a perpendicular line to the tongue existence plane (dotted line T) of the bottom end of the male threaded portion.) exist beyond a tip end portion (part of side of length Y2 of the tongue 41) toward the protrusion direction 'V'; and a non-protrusion condition in which the legs of the perpendicular lines extending to the tongue existence plane from the at least two contact points or the at least two contact points themselves exist in a counter direction opposite to the protrusion direction 'V' from a minimum protrusion tip end portion (here, the tip end portion of the tongue 41 (part of side of length Y2 of the tongue 41) is at the same position with respect to the opposite direction) which is located at one position of the most opposite direction among the positions where the tip end portions (part of side of length Y2 of the tongue 41) of the plurality of the tongues 41 exist to the protrusion direction 'V' or at the same one position as that of the minimum protrusion tip end portion in the protrusion direction 'V'.

In the present apparatus 11, the additional contact portion (height adjusting parts 91*a*, 91*b*) is configured by including a male screw member (a male threaded portion 92) having male threads inscribed on an outer surface thereof and a female screw member (a female threaded portion 93) having female threads inscribed on an inner surface to engage with the male screw. One (here, a female threaded portion 93) of the male screw member (a male threaded portion 92) and the female screw member (a female threaded portion 93) is directly or indirectly fixed to the tongue forming means (a securing portion 40). Then, the other (a male threaded portion 92) of the male screw member (a male threaded portion 92) and the female screw member (a female threaded portion 93) is turned in a normal direction or a reverse direction relatively to the one (a female threaded portion 93) such that an end part (here, the bottom end of the male threaded portion 92) existing on a protrusion direction 'V' side of the other (a male threaded portion 92) is displaced (here, the axis (longitudinal direction) of the male screw member (male threaded portion 92) is aligned toward the protrusion direction V, and the end part (here, the bottom end of the male threaded portion 92) existing on the protrusion direction V side of the other (female threaded portion 93) is displaced along the protrusion direction V with respect to the other (female threaded portion 93).) to have a displacement component in the protrusion direction 'V'; and the end part (a male threaded portion 92 bottom end) existing on the protrusion direction 'V' side of the other (a female threaded portion 92) is at least one of the at least two contact points.

In the present apparatus 11, a closing valve (here, a closing valve part 94) with which the end part on the protrusion direction 'V' side of the female screw member (a female threaded portion 93) is closed, when the end part on the protrusion direction 'V' side of the female screw member (a female threaded portion 93) is located farther toward the protrusion direction 'V' side than the end part of the male threaded portion (a male threaded portion 92), and the end part (a male threaded portion 92 bottom end) on the protrusion direction 'V' side of the male screw member (male threaded portion 92) is allowed to stick out of or retreat from the end part of the projection direction of the female screw member may be included. As a closing valve (a closing valve part 94), any can be used as long as the end part on the protrusion direction 'V' side of the female screw member (a female threaded portion 93) is closed, when the end part on the protrusion direction 'V' side of the female screw member (a female threaded portion 93) is located farther toward the protrusion direction 'V' side than the end part of the male threaded portion (a male threaded portion 92), and the end part (a male threaded portion 92 bottom end) on the protrusion direction 'V' side of the male screw member (male threaded portion 92) is allowed to stick out of or retreat from the end part of the projection direction of the female screw member. Various kinds of closing valves are known for such a closing valve. For example, if one end part of a rubber tube (here, the rubber tube allows an end part of the male screw member (a male threaded portion 92) on the protrusion direction 'V' side to pass through the inside of the rubber tube), which is normally in a flat shape as if it were pressed from outside, is attached to the end part on the protrusion direction 'V' side of the female screw member (a female threaded portion 93), the other end part (the end part of the rubber tube on the protrusion direction V side) of the rubber tube is in such a flat shape that the end part of the female screw member (a female threaded portion 93) on the protrusion direction 'V' side is closed when the end part of the female screw member (a female threaded portion 93) on the protrusion direction 'V' side is located farther toward the protrusion direction 'V' side than the end part of the male screw member (a male threaded portion 92) on the protrusion direction 'V' side. And the end part of the male screw member (male threaded portion 92) on the protrusion direction 'V' side pushes out the flat rubber tube from inside such that the end part of the male screw member (male threaded portion 92) on the protrusion direction 'V' side can stick out and retreat from the other end (the end part of the rubber tube on the protrusion direction V side) of the rubber tube (the end part of the male screw member (male threaded portion 92) on the protrusion direction 'V' side can freely stick out and retreat from the end part of the female screw member (female threaded portion 93) on the protrusion direction 'V' side).

In the present apparatus 11, a finger grip portion to which force to rotate the male screw member (male threaded portion 92) is applied is provided to a portion of the male screw member (male threaded portion 92) projecting from the female screw member (female threaded portion 93) in an opposite direction to the protrusion direction 'V'. Here, the finger grip portion is a grasping portion formed with a plate member having both main surfaces in an approximately oval shape, which is provided to a top end of the male screw member (male threaded portion 92).

In the present apparatus 11, the passing gap changing means (the lateral slide portion 60, the vertical slide edge 81 and mechanism sliding the same (the vertical slide edge slide rails 86*a*, 86*b*, 86*c*; the vertical slide edge slide levers 85*a*, 85*b*, 85*c*; the slide member 88*a*, 88*b*, 88*c*; and the vertical slide edge securing screws 83*a*, 83*b*, 83*c* are included), and the height adjusting part 91) comprises gap width adjusting means (here, the lateral slide portion 60) to close the gaps 42 formed between the plurality of tongues 41 in a parallel direction to the bottom defining line (a line segment along the long side 43*a*).

In the present apparatus 11, the gap width adjusting means (the lateral slide portion 60) comprises a width adjusting member (here, it comprises the lateral slide base plate 63 and a plurality of tongues 61) provided slidably relatively along the bottom defining line (a line segment along the long side 43*a*) with respect to the gaps 42 such that at least part of the gaps 42 formed between the plurality of tongues 41 may be closed.

In the present apparatus 11, the width adjusting member (comprising the lateral slide base plate 63 and a plurality of tongues 61) is a plate member having notches (corresponding to a gap formed between the plurality of tongues 61) in same shapes as those of the gaps 42 formed between the plurality of tongues 41. And the plurality of tongues 61 are formed with a plate member in a belt shape having notches (corresponding to a gap formed between the plurality of tongues 61) being in approximately the same shape of gaps 42 formed between the plurality of tongues 41 formed along the long edge (the edge along the side of length Z2 of the tongue 61).

In the present apparatus 11, the passing gap changing means (the lateral slide portion 60, the vertical slide edge 81 and mechanism sliding the same (the vertical slide edge slide rails 86*a*, 86*b*, 86*c*; the vertical slide edge slide levers 85*a*, 85*b*, 85*c*; the slide member 88*a*, 88*b*, 88*c*; and the vertical slide edge securing screws 83*a*, 83*b*, 83*c* are included), and the height adjusting part 91) comprises variable weir means (here, the vertical slide edge 81 and mechanism sliding the same (the vertical slide edge slide rails 86*a*, 86*b*, 86*c*; the vertical slide edge slide levers 85*a*, 85*b*, 85*c*; the slide member 88*a*, 88*b*, 88*c*; and the vertical slide edge securing screws 83*a*, 83*b*, 83*c* are included), and the height adjusting part 91) to close the gaps 42 formed between the plurality of tongues 41 with a variable width toward the protrusion direction 'V' from the bottom defining line (a line segment along the long side 43*a*).

In the present apparatus 11, the variable weir means (the vertical slide edge 81 and mechanism sliding the same (the vertical slide edge slide rails 86*a*, 86*b*, 86*c*; the vertical slide edge slide levers 85*a*, 85*b*, 85*c*; the slide member 88*a*, 88*b*, 88*c*; and the vertical slide edge securing screws 83*a*, 83*b*, 83*c* are included), and the height adjusting part 91) comprises a weir member (a vertical slide edge 81) in a belt shape to close the plurality of gaps 42 formed between the plurality of tongues 41 over a bottom defining line (a line segment along the long side 43*a*) direction and to slide freely relative to the tongue forming means (securing portion 40) in the protrusion direction 'V' and the opposite direction thereto, the weir member having a main surface parallel to the tongue existence plane (a dotted line 'T').

In the present apparatus 11, an edge portion (bottom edge 82*b*) on the protrusion direction 'V' side of the weir member (vertical slide edge 81) is formed along the line segment and the weir member (vertical slide edge 81) slides such that an angle between a straight line including an orthographic projection of the edge portion (bottom edge 82*b*) of the protrusion direction 'V' side of the weir member on the tongue existence plane (a dotted line 'T') and a straight line including the bottom defining line (a line segment along the long side 43*a*) may be variable. This corresponds to the above (Adjustment 3). In this way, the inclination of the ridge portion (upper surface) of the ridge-and-groove shape with respect to the width direction is changed by changing the inclination of the vertical slide edge 81 with respect to the surface of the subject slab 103 by S4, S5, S6 shifting the positions of the vertical slide edge securing screws 83*a*, 83*b*, 83*c* with respect to the main body 21.

In the present apparatus 11, the contact means (tongue 41 and height adjusting parts 91*a*, 91*b*) includes at least two or more tip end portions (a side of length Y2 of a tongue 41) of the plurality of tongues 41. In the present apparatus 11, the grasping means (here, a main body 21) is attachable to and detachable from the tongue forming means (a securing portion 40). Here, the securing portion fixing bolts 45*a*, 45*b* are inserted into the through hole 23*h* formed in the main body 21 (main body lower portion 23) and securing portion fixing nuts 47*a*, 47*b* are engaged with the securing portion fixing bolts 45*a*, 45*b* (near the top end) such that the securing portion 40 is fixed to the main body 21 (main body lower portion 23). Therefore, it is possible to remove the securing portion 40 by releasing the securing portion fixing nuts 47*a*, 47*b*.

In the present apparatus 11, a front rising wall member (here, front wall member 66) formed in a rising manner in an opposite direction to the protrusion direction 'V' and separately from the grasping means (main body 21) is provided such that an orthographic projection of an outer surface (here, front surface 22*a*) of the grasping means (here, main body 21) on the tongue existence plane (a dotted line 'T') and an orthographic projection of at least part appearing in an opposite direction to the protrusion direction 'V' from the bottom defining line (a line segment along the long side 43*a*) on the tongue existence plane (a dotted line 'T') overlap.

The present apparatus 11 comprises: a stand 96 which can have the present apparatus 11 stand by itself such that a tip end thereof contacts on the horizontal virtual surface (for example, the surface of the subject slab (concrete slab) 103).

The present apparatus 11 comprises: horizontal level confirming means (here, bubble tube level 13) for checking whether the bottom defining line (a line segment along the long side 43*a*) is horizontal or not.

In the present apparatus 11, the grasping means (her, a main body 21) comprises: a grasping bar (here, a bar-shaped grasping portion 15*a*) shaped in a bar shape extending approximately in parallel to the bottom defining line (a line segment along the long side 43*a*).

And in the step of forming the ridge-and-groove shape with the above-mentioned present apparatus 11, the step of applying the adhesive mortar 101 onto the surface of the subject slab with a predetermined width as shown in FIG. 16 corresponds to the providing step of providing the adhesive substance (adhesive mortar 101) onto the laying surface (surface of the subject slab 103) of the present method. And the step of moving the present apparatus 11 in the arrow J direction (a predetermined width K and a vertical direction) and forming the ridge-and-groove shape 104 corresponding to the shape of slits 49 as the adhesive mortar 101 passes through the slits 49 of the present apparatus with the adhesive mortar 101 corresponds to the shape forming step of forming the ridge-and-groove shape corresponding to gaps between the plurality of tongues 41 by passing the adhesive substance (adhesive mortar 101) through the gaps between the plurality of tongues 41 by moving the present apparatus 11 over the laying surface (surface of the subject slab 103) onto which adhesive substance (adhesive mortar 101) is provided in the providing step under the condition that the contact means (a tongue 41 and height adjusting parts 91*a*, 91*b*) is kept in contact with the laying surface (surface of the subject slab 103). By the above providing step and the shape forming step, the forming method (present method) of forming the upper surface in the ridge-and-groove shape of the adhesive substance (adhesive mortar 101) applied onto the laying surface (surface of the subject slab) with the present apparatus 11 is configured.

And in the present method, the shape forming step may be performed while the additional contact portion (height adjusting parts 91*a*, 91*b*) is in a projection state.

EXPLANATION OF NUMERALS

11 present apparatus 13 bubble tube level 15 grasping portion 15*a* bar-shaped grasping portion 15*ac* groove 15*b* finger catch 15*bc* convex-and-concave 15*c*1, 15*c*2 engaging part 15*d*1, 15*d*2 fixing bracket 21 main body 22*a*, 22*b* surface 23 main body lower portion 23*h* through hole 24 tongue part receiving groove 25 main body upper portion 25*c* notch 29*a*, 29*b* height adjusting part support portion 40 securing portion 41 tongue 42 gap 43 securing portion base plate 43*a*, 43*b* long side 43*h*1, 43*h*2 tapped hole 43*k*1, 43*k*2 lever support plate 43*s* slit 43*q* lever support bar 44 ridge 45*a*, 45*b* securing portion fixing bolt 47*a*, 47*b* securing portion fixing nut 49 slit 51,53 gasket 60 lateral slide portion 61 tongue 63 lateral slide base plate 63*a*, 63*b* long side 64 groove 64*a*, 64*b* ridge 65 lateral slide portion supporting portion 65*a* rising portion 65*b* hinge portion 65*c* tongue portion 65*ch* elongated hole 66 front wall member 66*a* ridge 67*f* rack part 68*a*, 68*b* lateral slide portion securing screw 69 lateral slide portion slide lever 69*a* bar main body 69*c* pinion portion 81 vertical slide edge 82*a* top edge 82*b* bottom edge 83*a*, 83*b*, 83*c* vertical slide edge securing screw 85*a*, 85*c* vertical slide edge slide lever 86*a*, 86*b*, 86*c* vertical slide edge slide rail 87 notch engaging spring 88*a*, 88*b*, 88*c* slide member 89 vertical slide edge slide plate 89*a* main surface 91,91*a*, 91*b* height adjusting part 92 male threaded portion 93 female threaded portion 94 closing valve 96 stand 96*a* base member 96*b* end member 101 adhesive mortar 103 subject slab (concrete slab) 104 ridge-and-groove shape 105 placing surface While the foregoing describes the present invention in relation to illustrations and examples, it is understood that it is not intended to limit the scope of the invention to the illustrations and examples described herein. On the contrary, it is intended to cover all alternative modifications and equivalents that may be included in the spirit and the scope of the invention as defined by the appended claims.

What is claimed is:

1. A forming apparatus to apply adhesive substance to adhere a tile on a laying surface over which the tile is laid, comprising:

tongue forming means including a plurality of tongues having respective base ends thereof and a securing portion base plate having a side to which the base ends of the plurality of tongues are connected wherein the plurality of tongues extends from the respective base ends and are aligned in a substantially same direction such that the plurality of tongues form gaps therebetween;

grasping means directly or indirectly fixed to the tongue forming means, the grasping means to be grasped by a user; and contact means directly or indirectly fixed to the tongue forming means and having at least two contact points to contact the laying surface to which the adhesive substance is applied.

2. The forming apparatus according to claim 1 further comprising passing gap changing means which changes areas of passing gaps defined by the plurality of gaps and the laying surface.

3. The forming apparatus according to claim 2 wherein the passing gap changing means comprises a height adjusting part.

4. The forming apparatus according to claim 3 wherein:

the height adjusting part comprises a male screw member having male threads inscribed on an outer surface thereof; and a female screw member having female threads inscribed on an inner surface to engage with the male screw;

one of the male screw member and the female screw member is directly or indirectly fixed to the tongue forming means and comprises an end part; and the end part comprises one of the at least two contact points.

5. The forming apparatus according to claim 4 comprising a closing valve to close the female screw member when the male screw member comprises the end part located within the female screw member and to allow the end part to stick out of the female screw member.

6. The forming apparatus according to claim 4, comprising a finger grip portion to which force to rotate the male screw member is applied, the finger grip portion being provided to an opposite end to the end part.

7. The forming apparatus according to claim 2, wherein the passing gap changing means comprises gap width adjusting means to close at least part of the gaps formed between the plurality of tongues.

8. The forming apparatus according to claim 7, wherein the gap width adjusting means comprises a width adjusting member provided slidably along the plurality of tongues of the securing portion base plate such that the at least part of the gaps formed between the plurality of tongues may be closed.

9. The forming apparatus according to claim 8, wherein the width adjusting member is a plate member having a plurality of tongues and gaps formed between the plurality of tongues of the plate member.

10. The forming apparatus according to claim 2, wherein the passing gap changing means comprises variable weir means to close at least part of the gaps formed between the plurality of tongues.

11. The forming apparatus according to claim 10, wherein the variable weir means comprises a weir member in a belt shape to close the at least part of the plurality of gaps formed between the plurality of tongues by sliding along the plurality of tongues.

12. The forming apparatus according to claim 11, wherein:

the weir member comprises a bottom edge on a side of the belt shape and the weir member slides such that the bottom edge of the weir member may be variably-inclined to the securing portion base plate.

13. The forming apparatus according to claim 1, wherein the contact means includes at least two tip end portions of the plurality of tongues.

14. The forming apparatus according to claim 1, wherein the grasping means is attachable to and detachable from the tongue forming means.

15. The forming apparatus according to claim 1, comprising: a front rising wall member to cover the grasping means from an opposite side of the forming apparatus to the side of the securing portion base plate such that the front rising wall member extends above the securing portion base plate and that the plurality of tongues extend under the securing portion base plate.

16. The forming apparatus according to claim 1, comprising: a stand extending from an opposite side of the forming apparatus to the side of the securing portion base plate such that a tip end of the stand may contact the laying surface.

17. The forming apparatus according to claim 1, comprising: means for checking the horizontal level whether the forming apparatus is horizontal or not.

18. The forming apparatus according to claim 1, wherein the grasping means comprises: a grasping bar shaped in a bar shape extending approximately in parallel to a longitudinal direction of the securing portion base plate.

19. A forming apparatus to apply adhesive substance to adhere a tile on a laying surface over which the tile is laid, comprising:

a securing portion base plate;

a plurality of tongues extending from a side of the securing portion base plate and being aligned in a substantially same direction such that the plurality of tongues form gaps therebetween;

a main body provided above and extending along the securing portion base plate such that the plurality of tongues extend under the securing portion base plate wherein the main body comprises a grasping portion; and a height adjusting part provided to the main body wherein the height adjusting part comprises an end part, wherein a tip end of at least one of the plurality of tongues and the end part may contact the laying surface to which the adhesive substance is applied.

* * * * *